United States Patent [19]

Zeldman

[11] 4,268,214

[45] May 19, 1981

[54] EXCAVATOR FRONT END

[75] Inventor: Maurice I. Zeldman, Pittsburgh, Pa.

[73] Assignee: Bucyrus-Erie Company, South Milwaukee, Wis.

[21] Appl. No.: 23,694

[22] Filed: Mar. 26, 1979

[51] Int. Cl.[3] ..... E02F 3/42

[52] U.S. Cl. ..... 414/694; 414/710

[58] Field of Search ..... 414/694, 695.6, 695.7, 414/695.8, 695.9, 706, 707, 710, 712, 713, 917; 212/144, 187, 266

[56] References Cited

U.S. PATENT DOCUMENTS

| | | | |
|---|---|---|---|
| 742,600 | 3/1969 | Bingley | 414/694 |
| 952,383 | 3/1910 | Tomer | 74/52 |
| 1,186,617 | 6/1916 | Talboys | 414/694 |
| 1,397,543 | 11/1921 | Peppin | 414/694 |
| 1,652,136 | 12/1927 | Arden | 414/915 |
| 2,815,250 | 12/1957 | Thornton-Trump | 414/592 X |
| 3,376,983 | 4/1968 | Wilson | 414/691 |
| 3,452,890 | 4/1969 | Learmont | 414/694 |
| 3,465,903 | 9/1969 | Wilson | 414/694 |
| 3,578,188 | 5/1971 | Drieschner | 414/694 |
| 3,587,888 | 6/1971 | Warren | 414/733 X |
| 3,690,483 | 9/1972 | Kraschnewski | 414/692 |
| 3,952,890 | 4/1976 | Armstrong | 414/917 X |
| 4,074,821 | 2/1978 | Long | 414/694 |

FOREIGN PATENT DOCUMENTS

| | | | |
|---|---|---|---|
| 43875 | 12/1960 | Poland | 414/695.7 |

OTHER PUBLICATIONS

"Hitachi UH-30 Excavator Tough, Reliable and Durable"; Barlow.

"Gear Machinery Mechanisms"; Jensen, Gear Design and Application.

"From German Sources, a Compendium of Machinery Mechanisms"; Jensen.

"Hydraulic Power for Mine Shovels", Padoutt; Mining Magazine.

"Special Motion Gear Mechanisms"; Rappaport; Gear Design & Application.

Liebherr R981 H D Hydraulic Shovel.

O & K Orenstein & Koppel RH 75; RH 60.

Demig Beumaschinen H101.

Marion Tower Shovel Line.

*Primary Examiner*—Stephen G. Kunin

*Assistant Examiner*—Terrance L. Siemens

*Attorney, Agent, or Firm*—Quarles & Brady

[57] ABSTRACT

A front end mechanism for an excavating machine is shown having a boom pivotally mounted at its foot and a dipper stick pivoted to the forward end of the boom that carries a dipper at its outer end. The mechanism includes a rotatable hoist member coaxial with the pivoted boom foot that is in the form of either a gear or a lever arm, a hoist drive that alternately rotates the hoist member for effecting hoist and lower motions of the machine or that holds the hoist member stationary, a moment arm forming a part of the inner end of the dipper stick which is in the form of either a gear or a linear portion of the dipper stick, a coupling member interposed between the hoist member and the dipper stick moment arm which is in the form of either an elongate strut tying the hoist member and moment arm together or an idler gear when both the hoist member and the moment arm are in the form of gears, and a crowd drive that can alternately pivot the boom with respect to the hoist member or hold these two elements fixed with respect to one another.

29 Claims, 12 Drawing Figures

EXCAVATOR FRONT END

BACKGROUND OF THE INVENTION

This invention relates to shovel type excavators, and more particularly to front end mechanisms for use in these and similar machines.

Shovel type excavators for construction, mining and other earth moving tasks are characterized by the provision of a forwardly extending boom to which a dipper stick is pivotally attached. A dipper, or bucket is mounted on the outer end of the dipper stick, and digging is accomplished by driving the dipper through the earth in a shoveling or scooping movement. The loaded dipper is then raised and swung to a position where the load is dumped. Usually, an excavator imparts two principal movements to its dipper. One is a crowdretract motion in which the dipper is translated either outward or inward of the machine proper. The second is a hoist-lower motion in which, as the term implies, the dipper is either raised or lowered. When the two motions are coordinated the dipper can be manipulated in most any path desired within the envelope of its permissible range of movement.

Conventional type power shovels used for mining and excavating employ a boom fixed in a position extending obliquely forward and upward from a machinery platform. A dipper stick is pivotally mounted approximately at the longitudinal center of the boom and is also reciprocably movable in its lengthwise direction. A dipper is mounted at the outer end of the dipper stick, and a hoist rope runs upwardly from the dipper to a sheave at the top of the boom, from which it extends downwardly to the machinery platform. This form of construction is illustrated in U.S. Pat. No. 3,690,483 entitled "Power Shovel Front End". Hoist-lower motion for such a shovel is imparted to the dipper by drawing in and paying out the hoist rope. The crowd-retract motion for the dipper is accomplished by thrusting the dipper stick outwardly along its axial length for crowding, and by drawing it inwardly for retracting. The dipper is usually fixed in position at the outer end of the dipper stick, so the dipper teeth remain at all times in a set orientation with respect to the dipper stick. The hoist motion supplies the primary digging force, and normally pulls the dipper upwardly through a bank being excavated. The crowd motion is also applied to the dipper during the digging stroke to urge the dipper into the bank being excavated. The crowding force, however, contributes little to the digging force exerted at the dipper teeth, and the resulting path for the dipper through a complete digging stroke takes a generally parabolic configuration entailing a considerable upward component of motion.

One drawback to the digging pattern of a conventional type power shovel is that the digging force applied through the upward pull of the hoist rope is oblique to the path of excavation traveled by the dipper teeth. As a result, the digging force available is not applied in the most efficient manner. Further, the crowd force required to keep the dipper in the bank pushes the sides of the dipper teeth and the dipper heel into the earth, so that considerable sliding friction is created between the dipper and the material being excavated. This friction must be overcome by the hoist rope pulling the dipper through the bank, with a resultant inefficiency.

Another deficiency of the conventional type shovel is that due to the large hoist component in the digging stroke the ability to cut a flat floor over an area is extremely limited. In mining operations, after excavation is completed it is frequently necessary to use other forms of machinery for cleaning up the area and leaving a level surface. A still further problem of these shovels concerns shallow excavations. Since substantial vertical cuts must be taken to fill the dipper, inefficiency results when the bank being excavated does not afford adequate vertical height for taking a full cut.

Another form of common construction for large power shovels is shown in U.S. Pat. No. 3,376,983 entitled "Rope Crowd for a Knee Action Shovel". In this construction, the inner end of the dipper stick is pivoted to the upper end of the boom to provide an articulated, knee-type action between the boom and dipper stick. A separate crowd arm is also connected to the boom upper end for moving both the boom and dipper stick outward and inward in a crowd-retract stroke. The hoist motion is similar to the conventional type of construction discussed above, with a hoist rope extending downward from a sheave at the top of a mast to the dipper. The digging motions of these shovels are comparable to that of the conventional type machines already discussed, and they exhibit similar problems.

In recent years there has been a development of hydraulically operated mining and excavating shovels using hydraulic cylinders for manipulating a boom and dipper stick, and two forms of such shovels are shown in U.S. Pat. No. 3,491,906 for "Loader Apparatus with Crowd Capability" and U.S. Pat. No. 3,578,188 for "Bucket Actuated Means for Excavator". These excavators take the form of enlarged scooper-loaders, with the dipper stick pivoted at its inner end to the forward end of the boom. The boom pivots about its foot, or lower end, so that both the dipper stick and boom are pivoted in manipulating the dipper. One hydraulic cylinder pivots the boom, and is usually attached to the machinery deck. A second hydraulic cylinder extends outwardly to a connection with the dipper stick to pivot the dipper stick relative to the boom. Hydraulic cylinder components have been limited as to their practical size, and they also require considerable maintenance. Hydraulic cylinders and lines connected thereto are susceptible to dirt, dust and other debris, and when located in exposed positions near the point of digging are subject to damage. It has, therefore, remained desirable to employ a different manner of drive for an excavator to eliminate these deficiencies.

Electrical drive systems have been used in the conventional type of mining excavators which are highly reliable in their operation. They efficiently and effectively operate for long periods of time with less maintenance, and consequently are more desirable than the hydraulic cylinder type drive systems. Electric drives have, however, been limited in application to conventional front end designs having the drawbacks discussed above. It would be desirable to combine electric drives with the boom-dipper stick designs similar to those of hydraulic shovels, and to also incorporate a wristing motion for the dipper comprising a pivot of the dipper about its connection with the dipper stick. A wristing motion can improve machine versatility in loading and dumping, but has not been used to any substantial extent in conventional type electric drive shovels. Wristing is used extensively in the hydraulic machines referred to above, and has been taught in a limited fashion for use in front end systems of conventional mining machines, as in U.S. Pat. No. 3,243,063 entitled "Variable Pitch Excavator Dipper Mounting". It would be desirable to combine a full wristing action with an electric drive that powers the hoist, crowd and swing motions of the excavator.

SUMMARY OF THE INVENTION

The present invention resides in a front end mechanism for excavators and similar machines, and in its preferred form it has a boom member pivoted at its foot end, a dipper stick pivoted at the forward end of the boom member that includes a moment arm at its connection with the boom member, a dipper at the outer end of the dipper stick, a hoist member alongside the pivoted boom foot that can either turn with the boom member or be independent thereof, a coupling member interposed between the dipper stick moment arm and the hoist member, a hoist drive that can pivot the several members and the dipper stick in unison, and a crowd drive that rotates the boom member relative to the hoist member to effect a movement of the dipper stick relative to the other members.

The invention can be embodied in several forms of construction, with certain features to the several constructions. One common feature is the provision of a tiltable boom with a dipper stick pivoted to the boom forward end in combination with power drives for working the boom and dipper stick that are located inboard of the connection between the dipper stick and boom. In hydraulic excavators it is usual for the hydraulic cylinder that operates the dipper stick relative to the boom to extend forward from the boom to an outward connection with the dipper stick. This configuration places the hydraulic actuating cylinder close to the dipper and the region of excavation. In this position the cylinder is subjected to an intense environment of dust and dirt, and it is also exposed to rocks and solid earth fragments being excavated that can cause damage to the equipment. The forward position of the cylinder also moves the center of gravity of the front end mechanism outward with a consequent reduction in machine capacity.

In the present invention the power elements are located in a more inboard position, closer to the excavator machinery platform, and direct connection of a drive element with the dipper stick can be eliminated. This provides greater protection for the power elements and consequently reduces maintenance problems. Further, with the weight of the power elements being closer to the machine center, it follows that greater loads, or greater reach, can be achieved for an excavator to increase its efficiency.

The power elements for the crowd-retract and hoist-lower motions of the excavator can be rotary in nature, such as driving pinions working against gears, and this enables the excavator to use electric drives. Electric drives comprising generator sets, or other sources of electrical power, that incorporate controlled electric motors and gear reducers exhibit long life, and require only minimal maintenance. The inclusion of such drives in an excavator is a particular objective and advantage of some forms of the invention. To effectively utilize rotary electric drives, the invented front end mechanism incorporates a large gear at the foot of the boom member that is engaged by both the hoist-lower and crowd-retract drives. This gear functions as a rotatable reaction member for the crowd-retract drive, and this drive is mounted on the boom with output pinions in engagement with the gear to travel about is periphery. Such movement about the gear pivots the boom relative to the reaction member to obtain a crowd-retract motion. The hoist-lower drive, which is mounted on the machinery platform also has output pinions engaging the gear. This drive rotates the gear, boom and dipper stick as a unit to achieve the hoist-lower motions. The power input units being rotary in nature lend themselves to rotary electric drive systems that are well suited for operating excavator front end mechanisms.

If desired, hydraulic cylinder units can be used in practicing the invention rather than electric drive units to power the front end mechanism, and embodiments of this alternate type construction are illustrated herein in addition to embodiments utilizing rotary drive systems. The hydraulic cylinder units are located relatively inboard, and where the limited size of a hydraulic unit is satisfactory, and its low initial cost is advantageous, the hydraulic system can become a preferred form of the invention.

The invented front end mechanism joins the boom, the dipper stick, the power units and intermediary connecting elements in a manner that can automatically provide a straight line crowd-retract motion for the outer end of the dipper stick. The straight line motion is accomplished by operating the crowd drive alone, without any simultaneous hoist-lower motion, and this straight line motion also comprises the digging stroke for the excavator. Thus, the invention utilizes the forward thrust of a crowd motion alone as the power stroke for digging. Two principal advantages flow from this arrangement. First, the straight line digging motion can be horizontal from the base of the excavator, so that a long, level floor is cut by the digging stroke. This eliminates secondary clean up operations subsequent to excavation. Secondly, the crowding force moving the dipper outwardly from the machine is applied in the same direction as the alignment of the dipper teeth. This provides a digging stroke in which the dipper heel and dipper teeth are not pushed sidewardly against the bank being excavated, as in conventional shovels where the hoist motion provides the digging force and the crowd force merely retains the dipper in the bank. The utilization of the crowding motion as the digging stroke also permits the excavation of a bank by making outward cuts at the top of the bank, and then working down through the bank as upper layers are successively removed. The necessity of making relatively deep, vertical cuts through a bank is eliminated.

The front end mechanism produces its crowd motion by use of a toggle like action between the boom and the dipper stick. The boom and dipper stick are joined to have a knee type action between them, in which the boom is lowered and at the same time the dipper stick is both thrust forward and pivoted upward to accomplish the crowd motion. The present invention also applies a crowding force to the knee, or junction of the dipper stick with the boom, so that the spreading force that tends to align the dipper stick with the boom is applied as a toggle force which increases the digging force at the dipper teeth. Thus, for the larger reaches of the mechanism high crowding forces are maintained, and power units of larger size are not required for maintaining adequate crowding at the outer limits of the digging stroke.

In order to obtain a simultaneous pivot of both the boom and of the dipper stick through operation of only the crowd-retract drive, a unique coupling member is attached to the dipper stick. In preferred embodiments, this coupling interconnects between a moment arm forming a part of the inner end of the dipper stick and a hoist member on the machinery platform. The crowd-retract drive pivots the boom relative to the hoist member, and since the coupling connects with the hoist member it retards the inner end of the dipper stick from following the boom movement. As a result, the dipper stick turns with respect to the boom to obtain a compound motion for the dipper stick when the boom is pivoted. Both boom and dipper stick are thus manipulated in a crowd-retract motion by operating a single drive mechanism.

Preferred constructions also contemplate use of the hoist member for obtaining the hoist-lower motion. By holding the crowdretract drive locked and applying the hoist-lower drive to the hoist member, the hoist member, boom, coupling member and dipper stick are raised and lowered in unison. The construction of the hoist member and of the coupling member can take several forms. For utilizing rotary drive systems, the hoist member can be a gear in mesh with pinions of both of the drive systems. The coupling member can be a strut extending from the gear outward to the moment arm of the dipper stick, or it can take the form of gearing. In still further embodiments, the hoist member can be a pivoted lever arm, and hydraulic cylinders can be attached to this arm for operating the mechanism. Thus, the invention may be embodied in a variety of constructions.

It is an object of the invention to provide a front end mechanism for an excavator which produces a high crowd force in the direction of the dipper teeth, to more efficiently use the forces available when taking a cut into the earth.

It is another object of the invention to provide a horizontal, straight line digging motion to eliminate the need for additional clean-up after excavating.

It is another object to automatically provide straight line digging without having a simultaneously coordinate a hoist motion with a crowd motion of the machine.

It is still another object to provide a full wristing action for a dipper in an electrical drive excavator, and to have automatic wristing that maintains the dipper in its spatial orientation as the boom and dipper stick are manipulated.

It is another object to incorporate electric drive systems into an excavator having a scoop type loading operation.

It is a further object to power the crowding and hoisting mechanisms of a scoop type excavator with power systems that are positioned relatively inboard of the machine, and to provide an excavator front end mechanism of large capacity.

The foregoing and other objects and advantages of the invention will appear from the following description. In the description, reference is made to the accompanying drawings which form a part hereof, and in which there is shown by way of illustration several preferred embodiments of the invention. Such embodiments do not represent the full scope of the invention, and reference is made to the claims herein for interpreting the breadth of the invention.

The foregoing drawings include schematic illustrations of the invention, and as such are not intended as scale representations of actual embodiments.

DESCRIPTION OF THE SEVERAL EMBODIMENTS

Figure 1:
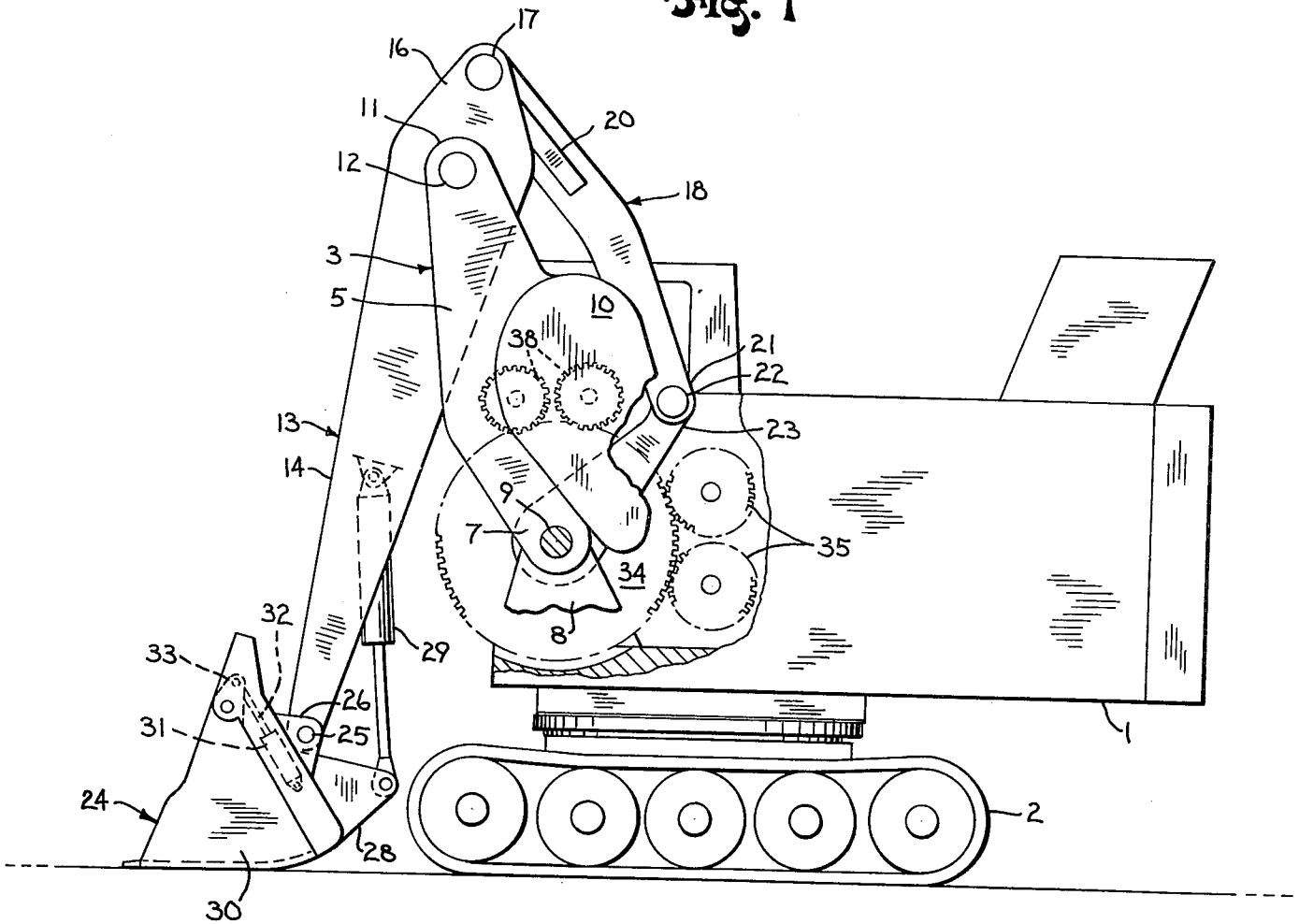
FIG. 1 is a left hand side view in elevation, with parts broken away, of an excavator incorporating a first embodiment of the front end mechanism of the present invention.
Figure 2:
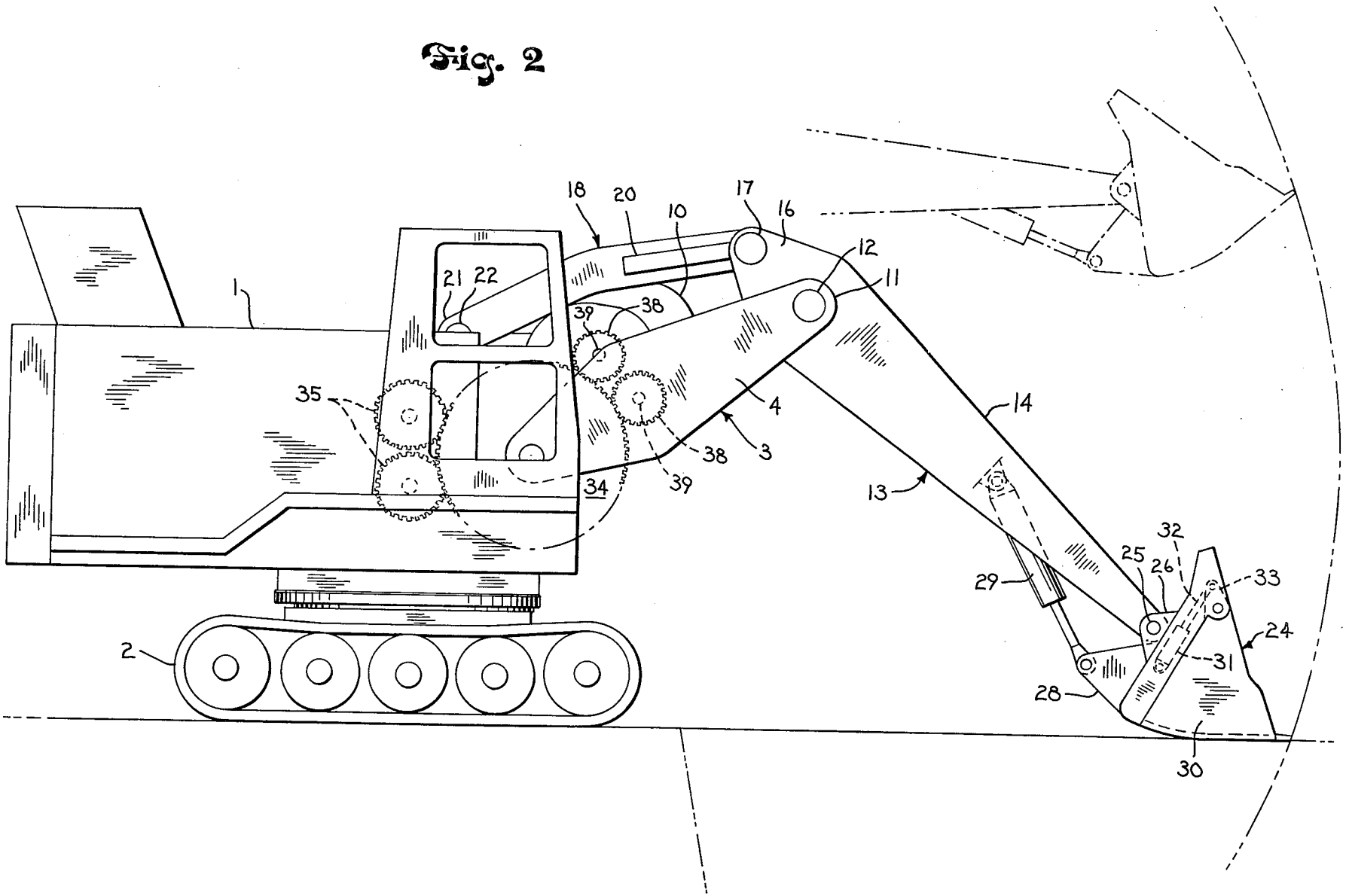
FIG. 2 is a right hand side view in elevation of the excavator with the dipper extended.
Figure 3:
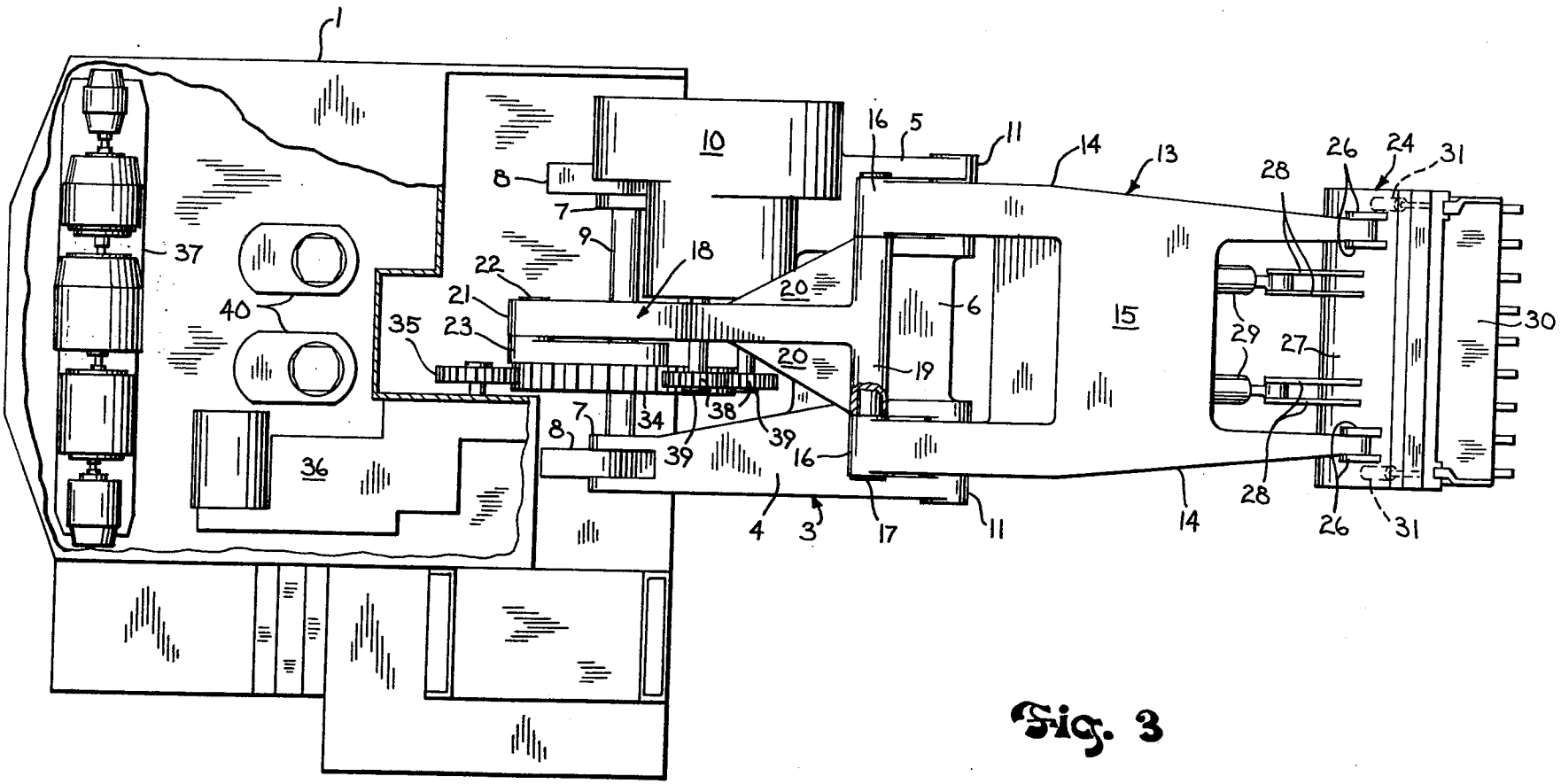
FIG. 3 is a top view of the excavator with the roof of the machinery housing partially broken away to show interior construction.

Referring to the first embodiment of FIGS. 1–4, there is shown an excavator having an upper works 1 rotatably mounted on a crawler unit 2. The upper works 1 provides a platform, or deck upon which machinery of the invention is mounted. A boom 3 of complex configuration includes a pair of laterally spaced, forwardly extending legs 4 and 5 formed of plates in a box-type construction. As seen in FIG. 3, the to boom legs 4, 5 are joined together at their forward ends by a transverse girder 6 that is also of box-type construction. Each boom leg 4, 5 has a bifurcated rear, or lower end that forms a boom foot 7 pivotally connected to one of a pair of stanchions 8 rising from the deck of the upper works 1. These pivoted connections include a load bearing boom foot shaft 9 that extends between the stanchions 8 and passes through the boom feet 7 to provide a support for the boom 3 at its lower end about which it pivots.

Figure 4:
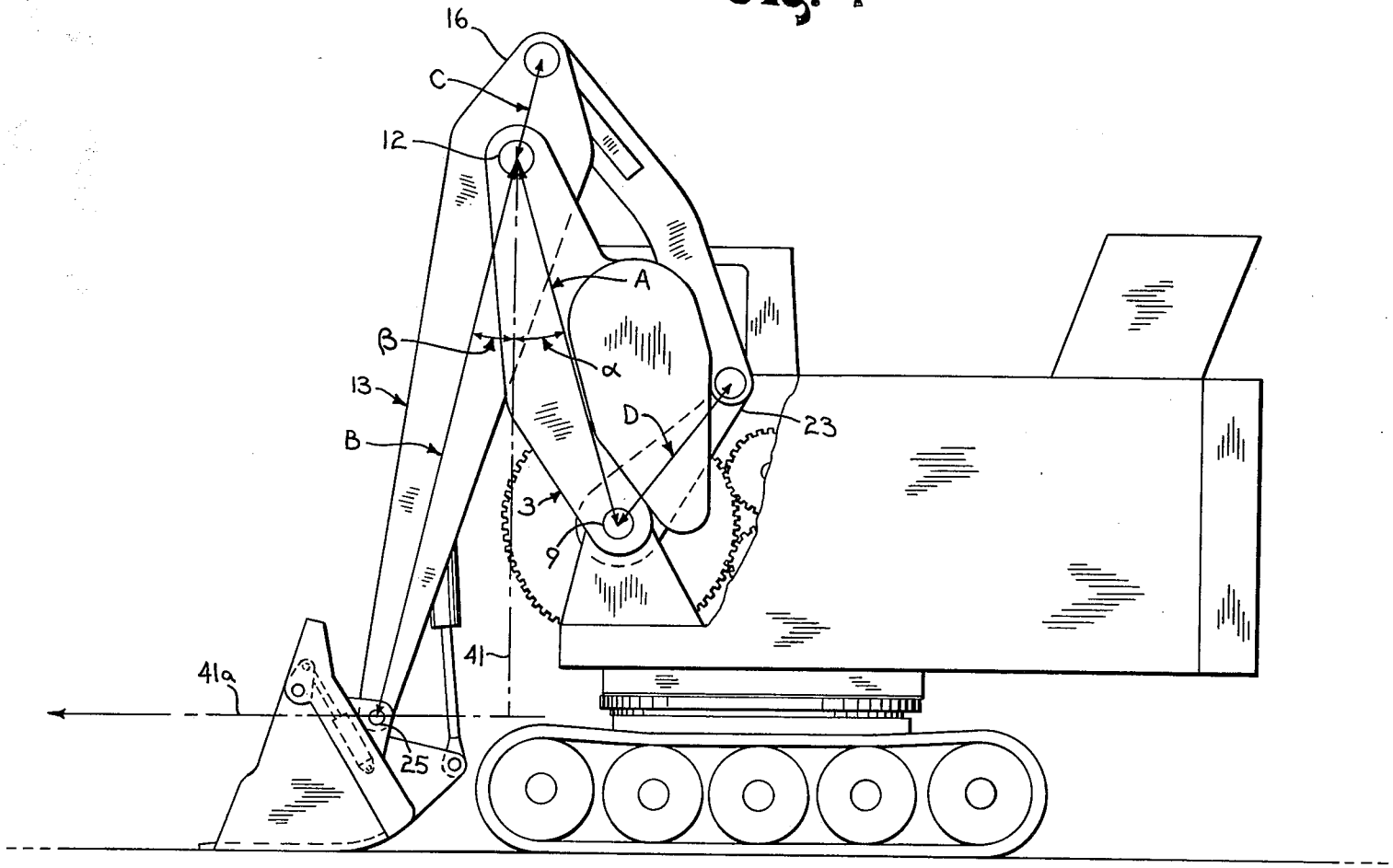
FIG. 4 is a left hand side view in elevation of the excavator similar to FIG. 1 with a portion of the side broken away, and with certain distances and angles being indicated by dimensional lines.

The boom leg 5 on the left side of the machine includes a housing 10 that encloses a crowd drive mechanism, and each boom leg 4, 5 has a bifurcated forward end 11 in which a pivot pin 12 is journaled. A dipper stick 13 is pivotally mounted on the pins 12, and as seen from above in FIG. 3, this dipper stick 13 is generally H-shaped with a pair of longitudinally extending side members 14 joined together at their centers by a crosswise box girder 15. The inner, or upper ends of the dipper stick side members 14 that are mounted on the pivot pins 12 extend upwardly and rearwardly from these pivot connections to form a pair of relatively short moment arms 16 that function to impart a turning motion to the dipper stick 13 about the pivot pins 12. Extending between the two moment arms 16 is a coupling shaft 17 that mounts the upper end of a coupling member in the form of a strut 18. For this mounting, the coupling strut 18 is provided with a transverse cylindrical sleeve 19 at its upper end that encircles the coupling shaft 17, and as seen in FIG. 3 the coupling strut 18 has a pair of triangular shaped reinforcing gussets 20 extending from its opposite sides that connect with the cylindrical sleeve 19 to provide a rigid structure. As seen in FIGS. 1, 2 and 4, the coupling strut 18 arches above the boom 3 and descends rearwardly and downwardly from the transverse sleeve 19 to its lower end 21 that is connected by a pin 22 to an outer end of a lever arm 23. The lever arm 23 is pivotally mounted at its lower end on the load bearing shaft 9, so as to have a common pivot axis with the boom feet 7.

A scoop type dipper 24 is pivotally connected to the outer ends of the dipper stick side members 14 by wrist pins 25 that are supported between dipper mounting brackets 26 projecting from the dipper back wall 27. The dipper back wall 27 also mounts two sets of rearwardly extending wristing plates 28, with each set of these wristing plates 28 being connected to the rod end of a hydraulic wristing cylinder 29. The cylinders 29 are pivotally joined at their blind ends to a forward face of the box girder 15. Operation of the cylinders 29 will wrist, or pivot the dipper 24 about the outer end of the dipper stick 13. For dumping a load from the dipper 24, the front body portion 30 of the dipper 24 is pivoted with respect to the back wall 27. The front portion 30 is moved between closed and open positions by hydraulic cylinders 31 enclosed within the sides of the back wall 27. For this operation a piston rod 32 for each cylinder 31 is connected to a bracket 33 at the top of the dipper front portion 30, so that as the piston rods 32 are retracted the dipper portion 30 will move outward from the back wall 27 to open the bottom of the dipper 24 for dumping.

A hoist member 34 in the form of a large diameter sun gear is borne on the load bearing shaft 9 in a position immediately alongside the lever arm 23. The gear 34 and lever arm 23 are fixed to one another, so that they turn in unison about the shaft 9. The arm 23 consequently is a part of the hoist member 34 that defines a radius arm that connects with the coupling member 18. A pair of hoistlower pinions gears 35 are located to the rear of and in mesh with the gear 34, and when the pinions 35 are rotated in tandem they will turn the gear 34 and pivot the lever arm 23. As seen in FIG. 3, the hoist-lower pinions 35 are driven by a hoist drive system 36 located within the housing of the upper works 1. The drive system 36 is shown as an electric drive that receives power from a generator unit 37 at the rear of the machine.

The previously mentioned crowd drive system within the housing 10 on the boom 3 includes a motor and gear reduction. A pair of crowd-retract pinion gears 38 are rotatably mounted on shafts 39 protruding from the housing 10 that form a part of the gear reduction. These pinions 38 are driven in tandem by the crowd drive, and are in mesh with the sun gear 34, so that as they are rotated they travel as planets around the periphery of the sun gear 34. The crowd drive system receives its power from the generator unit 37 at the rear of the upper works deck, similarly as the hoist drive system 36. The generator unit 37 also supplies power to a pair of swing motor drives 40 that are mounted on the upper works deck, as seen in FIG. 3.

Referring now to FIG. 1, the dipper 24 is shown in a retracted position at ground level immediately in front of the crawler unit 2 for the start of an operating cycle. The boom 3 is raised and the dipper stick 13 is brought in close, and an outward crowding stroke will now be made to move the dipper 24 to the position shown in FIGS. 2 and 3. For this crowd motion, the hoist-lower pinions 35 are held stationary, to thereby lock the hoist member comprised of the sun gear 34 and lever arm 23 from rotating. The crowd-retract pinions 38 are rotated to walk them forwardly about the periphery of the sun gear 34. Since the crowd-retract pinions 38 are mounted on the boom 3 their motion must pivot the boom 3 in a corresponding movement, wherefore the boom 3 turns on its boom feet in a forwardly and downwardly direction. This movement of the boom 3 causes the dipper stick 13 to be translated outward, but the stick 13 is also pivoted around the pins 12 by a retarding of the upper ends of the dipper stick moment arms 16. The dipper stick 13 consequently has a compound motion of moving outward with the boom forward end, and pivoting about the pins 12 that produces a digging thrust for the dipper 24. To accomplish the pivoting motion of the dipper stick 13, the lever arm 23 of the hoist member 34 is held stationary, so that the lower end 21 of the coupling strut 18 is fixed in position. The outer, or upper end of the strut 18 cannot, then, move forward with the same motion as the boom 3. As a result, the upper end of the coupling strut 18 holds back the dipper stick moment arms 16 from the full forward motion of the boom forward end. This retarding of the dipper stick moment arms 16 turns the dipper stick 13 clockwise (as seen in FIG. 1) about the pins 12, while the boom 3 pivots counterclockwise. The dipper stick 13 thus has a complex motion of being translated outward in response to the boom motion, and also of being pivoted to thrust its outer end outward at a greater rate of travel than its inner end at the location of the pins 12. As a result, the boom 3 and dipper stick 13 straighten with respect to one another in a toggle like action. In this crowding motion a force is applied through the knee of the toggle represented by the pins 12 to develop an outwardly directed force at the dipper 24. A reaction force also occurs at the coupling shaft 17 through the connection with the coupling strut 18 to apply a turning torque to the dipper stick moment arms 16 that pivots the dipper stick 13. The coupling strut 18 reacts at its lower end 21 against the lever arm 23 of the hoist member 34, and the crowd force of the pinions 38 also reacts against the large gear forming the hoist member 34. The hoist member 34 thus functions as a reaction member against which the forces generated in the crowd-retract motion work.

With the dipper 24 extended outwardly by the crowding motion, it now can be hoisted through an arc as shown by the phantom lines in FIG. 2. To accomplish this hoist motion, the crowd-retract pinions 38 are held motionless, so that they stay fixed in place on the gear forming the hoist member 34. This locks the boom 3 and gear 34 together as a unit, and when the hoistlower pinions 35 are now rotated to turn the gear 34 the turning motion causes an upward pivot of the boom 3. The lever arm 23 also pivots with the gear 34, so that the coupling strut 18 and dipper stick 13 remain in the same relative position with respect to the boom 3 throughout the hoist motion. Thus, the dipper 24 is hoisted from the lower position in FIG. 2 through an ascending arc to the upper position shown in phantom.

Although the digging stroke has been described solely as a crowd motion, and the raising of the dipper 24 as accomplished solely by a hoist motion, the crowd and hoist drives may, of course, be operated simultaneously. The dipper 24 then can be translated through any desired path of travel within the envelope of permissible limits of dipper travel. The spatial orientation of the dipper 24 during crowding and hoisting is under the control of the wristing cylinder 29. The operator coordinates the operation of this cylinder 29 with the other motions. The dipper 24 can then be held with the dipper teeth extending directly aligned in the direction of cutting during a digging motion, and after filling the dipper it can be tilted backward to hold the load as the dipper 24 is maneuvered into the position of dump. For dumping, the upper works 1 is swung through operation of the swing motors 40, and with the dipper 24 in dumping position the dump cylinders 31 are operated to clear the dipper 24 of its load. Lowering and retract motions for manipulating the dipper 24 and returning it to the beginning of an operating cycle are accomplished by reversing the rotation of the hoist-lower pinions 35 and crowd-retract pinions 38 from that for hoisting and crowding respectively.

The dipper stick 13 and the quadrilateral formed by the boom 3, the hoist member 34, the coupling strut 18, and the dipper stick moment arm 16 can be proportioned to develop a straight line crowding motion for the dipper 24, as depicted by the horizontal ground line in FIG. 2. This straight line motion for the outer end of the dipper stick 13 is obtained solely by a crowd or retract motion, and the critical distances and angles for obtaining the motion are indicated by designated dimension lines in FIG. 4, where the boom 3, dipper stick 13 and dipper 24 are shown in the same position as in FIG. 1. These dimensions are as follows:

A is the length of the boom 3 measured from the axis of the load bearing shaft 9 to the axis of the upper pivot pins 12;

B is the length of the dipper stick 13 measured from the axis of the upper pivot pins 12 to the axis of the wrist pins 25;

C is the radius of the dipper stick moment arm 16, this moment arm being a straight extension of the dipper stick length B;

D is the radius of the lever arm 23;

$\alpha$ is the angle measured between (i) an upright line 41 running through the axis of the upper pivot pins 12 that is perpendicular to the path of the straight line motion of the dipper stick outer end, which path is designated by the numeral 41*a* in FIG. 4, and (ii) the line A measuring the length of the boom 3; and $\beta$ is the angle measured between the same upright line 41 and the line B measuring the length of the dipper stick 13. ;p If the foregoing dimensions are selected to satisfy the following relationship:

$$A \cos \alpha + (B - A) = B \cos (\alpha [1 - \frac{D}{C}])$$

in which the value $\alpha[1-D/C]$ is the angle $\beta$, then the outer end of the dipper stick 13 at the pins 25 will travel in a straight line crowd motion. By proportioning the parts of the mechanism to develop such a horizontal straight line motion for the crowd a level floor can automatically be cut in the area being excavated with the crowd motion constituting the digging stroke. The machine operator need not coordinate both crowd and hoist motions simultaneously to make a straight line cut, as must be done in conventional hydraulic front end excavators.

An example of a dimensional relationship that satisfies the above equation is a boom length A equal to a dipper stick length B, for which the ratio of the length D to the length C must be 2. Another example is a dipper stick length B four times the length of the boom length A, for which the ratio D/C becomes 3/2. For the machine of FIGS. 1–4 the length B is 1.54 times the length A and the ration D/C is 1.80.

Since it is characteristic of the excavator that the digging stroke for loading the dipper 24 can simply constitute a crowd motion it follows that the dipper teeth can be oriented in the line of the corwd motion, and the digging force will then be applied with maximum effectiveness through the teeth for penetration of a bank being excavated. This contrasts with conventional shovels, in which the digging force is primarily developed by the hoist motion, and this motion is applied obliquely to the path of travel of the dipper teeth. The excavator of the invention also can be operated to cut away a bank by commencing excavation at the top of the bank, and then working downward in successive, outwardly directed digging strokes. The dipper 24 is raised to the top of the bank by rotating the boom 3 rearwardly with the dipper stick 13 retracted. Then a crowding stroke is used to dig away the top of the bank in a straight line motion. As the top is removed successive crowding, or digging strokes can commence at lower elevations, and the final digging can cut a level floor as indicated by the solid ground line in FIG. 2.

A trench can also be cut away in front of the machine, as illustrated in FIG. 2 by the phantom lines descending from the solid, level ground line. To this end, the boom 3 is lowered with the dipper stick 13 retracted. A crowding motion will now move the dipper 24 in a straight line at a downward inclination. Thus the front end mechanism of the invention can excavate at any desired level, similarly as other excavators, and can accomplish the excavations with a full outward reach in the digging stroke. The digging strokes contrast with a conventional shovel, in which the dipper is hoisted through the entire height of the bank by reason of the reeling in of a hoist line that runs up to the tip of a boom.

As noted hereinbefore, the boom 3 and dipper stick 13 move with a toggle like motion during crowding. The crowding force generated by walking the crowd pinions 38 around the large gear 34 applies a turning torque to the boom 3 to tilt it forward. A force is developed at the pins 12 joining the boom forward end 11 with the dipper stick 13. This force is applied downward to the dipper stick 13 as a toggle force thrusting out the outer end of the dipper stick 13. The outwardly directed crowding force at the dipper 24 becomes large, and as the toggle joint between the boom 3 and dipper stick 13 becomes straighter the crowding force is enhanced. Thus, a large digging force is sustained at the dipper teeth through the entire crowding stroke, and especially large prime movers are not required to maintain a large digging force at the outward reaches of the dipper.

A characteristic of the described structure is the support of the dipper stick 13 by a quadrilateral comprising the boom 3, the hoist member 34, the coupling member 18 and the dipper stick moment arm 16, which quadrilateral is pivoted at the boom foot. The power drives are attached to elements of the quadrilateral, and the quadrilateral becomes a four element motion control assembly that supports and manipulates the dipper stick 13. A characteristic of this construction is that the crowd and hoist drives are inboard of the dipper stick and of the region in which digging occurs. The power input units for hoist and crowd are therefore in protected positions, and the mass of these units is inboard to increase the efficiency of the excavator.

EMBODIMENT OF FIGS. 5-7

Figure 5:
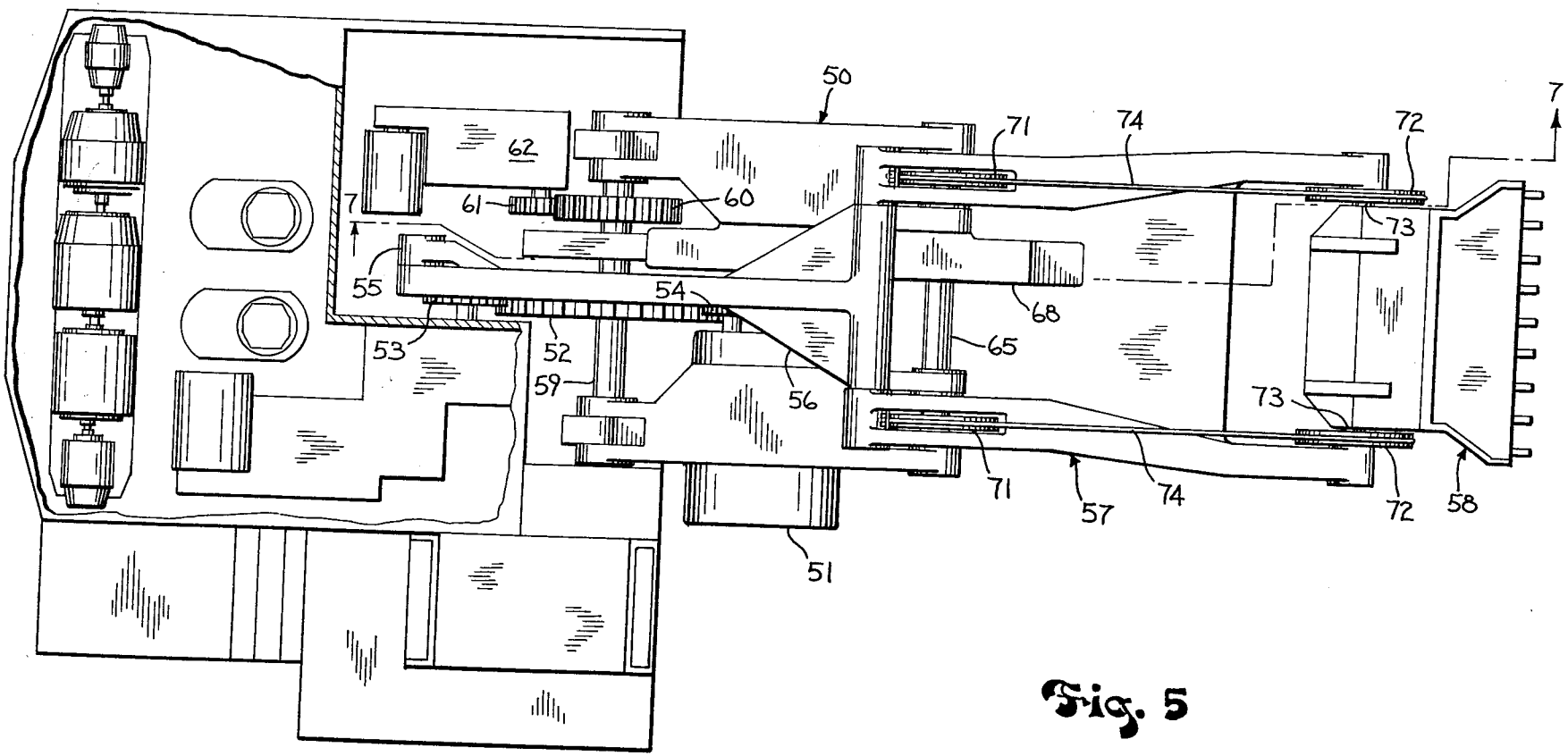
FIG. 5 is a top view, with the roof of the machinery housing partially broken away, of an excavator of the invention that has an alternative wristing mechanism for the dipper.
Figure 6:
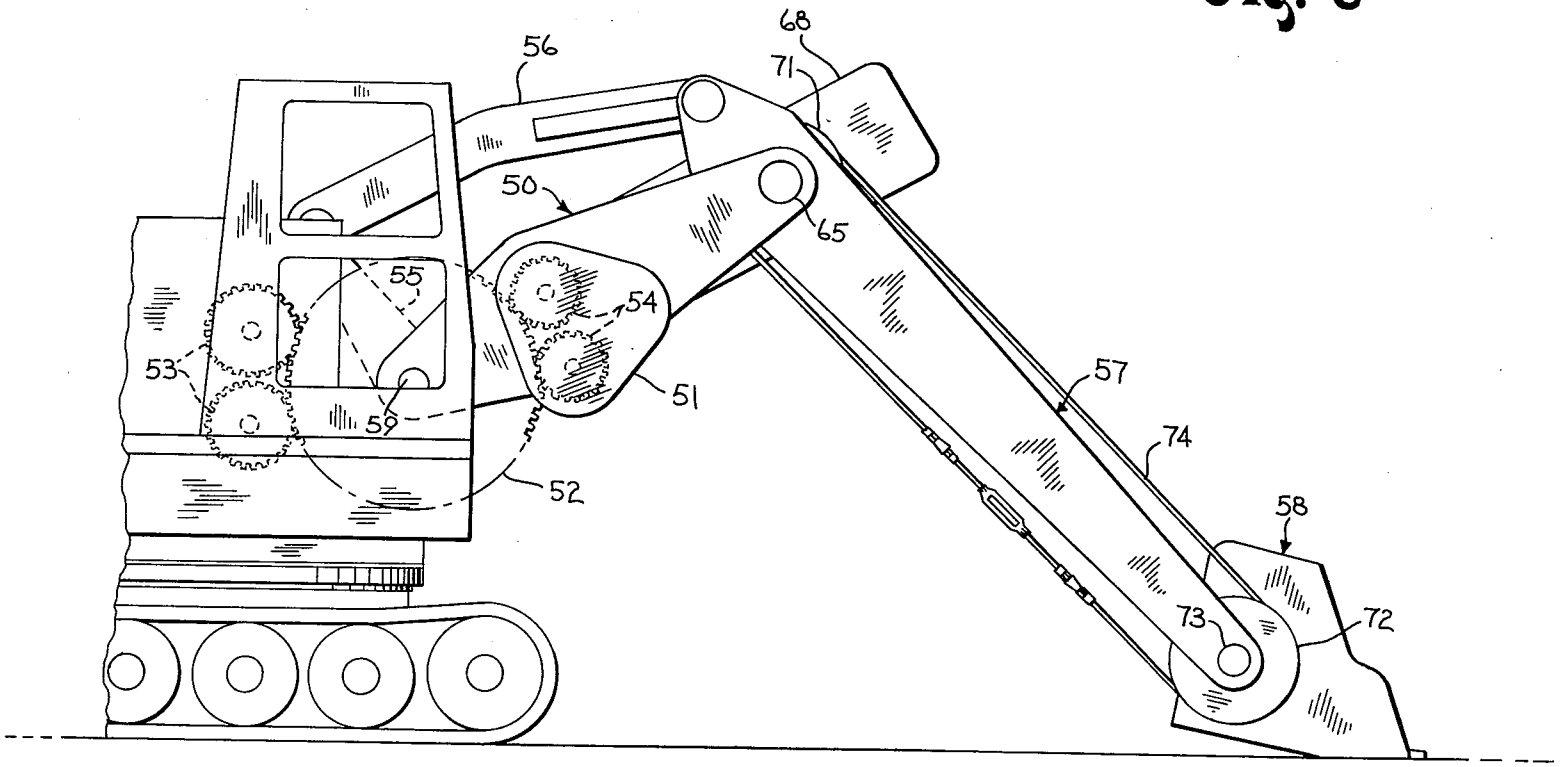
FIG. 6 is a right hand side view in elevation of the front portion of the embodiment of FIG. 5.
Figure 7:
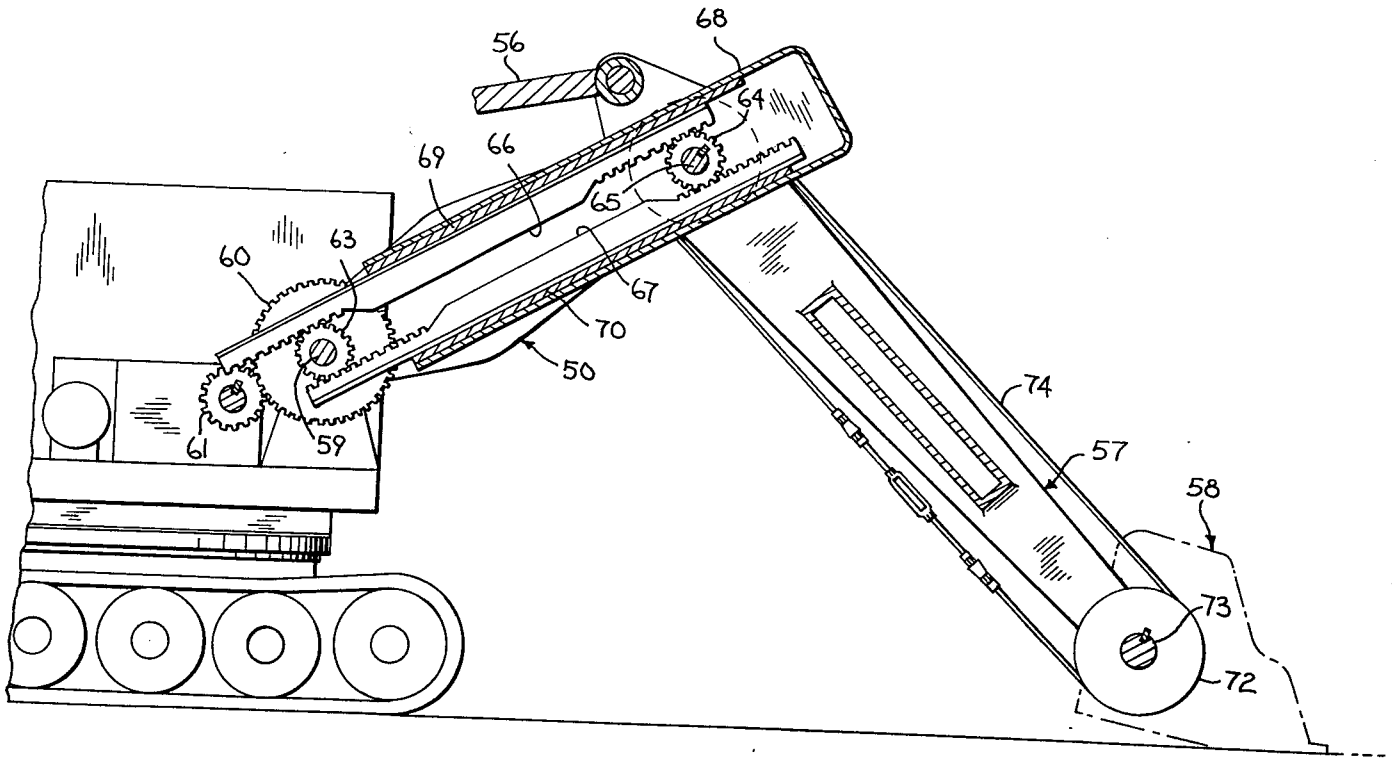
FIG. 7 is a view in section of the embodiment of FIG. 5 taken in the plane 7—7 indicated in FIG. 5.

FIGS. 5, 6 and 7 show an embodiment of the invention similar to that of FIGS. 1-4, but with the addition of a dipper wristing control that automatically maintains the spatial alignment of the dipper as the boom and dipper stick are manipulated. This embodiment has a boom 50 similar to the boom 3 of the first embodiment, except that a crowd drive mechanism 51 is mounted on the right hand side of the boom instead of the left hand side. A large sun gear 52, a pair of hoist-lower pinions 53 and a pair of crowd-retract pinions 54 are like their counterparts of the first embodiment. A lever arm 55 is secured to the sun gear 52 for rotation therewith, similarly as the lever arm 23 in the first embodiment, and a coupling strut 56 similarly arches outward over the boom 50 to connect with the upper end of a dipper stick 57 mounting a dipper 58 at its outer end.

A load bearing shaft 59 supported by stanchions on the machinery deck mounts the rear, or lower end of the boom 50. A wristing gear 60 is shown in FIGS. 5 and 7 that is mounted in suitable bearings on the shaft 59 for independent rotation. In mesh with the wristing gear 60 is a wristing input pinion 61 mounted on a shaft extending from an electrically driven wristing power unit 62. The power unit 62 is operated to turn the pinion 61 in either direction to impart a wristing motion to the dipper 58. As seen in FIG. 7, a first rack pinion 63 is coupled to the wristing gear 60 for rotation therewith, and a second rack pinion 64 is mounted on and keyed to an upper pivot shaft 65 which connects the dipper stick 57 to the boom 50. Longitudinally disposed between and in mesh with the pinion gears 63 and 64 are a pair of reciprocating racks 66 and 67. The racks 66, 67 rotate the second pinion gear 64 whenever the first pinion gear 63 is turned. The rack and pinion assembly comprising the pinions 63, 64 and the racks 66, 67 are housed within a box-like shrouding 68 that is secured to and lays alongside the left hand leg of the boom 50, as seen in FIG. 5. The shrouding 68 includes elongated guide rails 69 and 70, shown in section in FIG. 7, that hold the gear racks 66, 67 in position and provide a bearing surface along which they can slide.

As seen in FIG. 5, a pair of sheaves 71 are mounted on the upper pivot shaft 65 near its outboard ends. The sheaves 71 are keyed to the shaft 65, so that they will rotate in unison with the second rack pinion 64. A second set of sheaves 72 are keyed to dipper mounting wristing pins 73 at the outer end of the dipper stick 57. A rotation of the pins 73 will cause a like rotation, or wristing of the dipper 58. Connecting the upper sheaves 71 with the lower sheaves 72 are a pair of endless ropes 74 in the form of closed loops which translate motion of the sheaves 71 to the sheaves 72. In operation, when the wristing gear 60 is turned by the input pinion 61, the first rack pinion 63 will be similarly rotated. This moves the racks 66, 67 to rotate the second rack pinion 64. The second rack pinion 64 then rotates the upper sheaves 71, which through the ropes 74 cause the sheaves 72 to turn. This results in a wristing of the dipper 58 to change its spatial orientation as required for digging, hoisting and dumping.

The rack and pinion, and sheave and rope assemblage also functions to maintain the dipper 58 oriented in the position set by the operator. The two rack pinions 63, 64 and the two racks 66, 67 act as a first parallelogram in which the angular position of the upper pivot shaft 65 is maintained constant regardless of any tilting of the boom 50. The assembly of the sheaves 71, 72 and the ropes 74 form a second parallelogram that maintains the angular position of the dipper pins 73 constant regardless of any tilting of the dipper stick 57. By this arrangement, as the dipper is crowded outward with the end of the dipper stick 57 moving in a straight line the dipper 58 will automatically maintain its orientation, so the digging teeth will remain aligned with the path of travel and the dipper is oriented to receive a load. Also, as the dipper 58 is loaded and then tilted to a load holding position by operation of the power unit 62 it will retain its spatial orientation as it is hoisted and moved to a dumping position.

EMBODIMENT OF FIGS. 8 AND 9

Figure 8:
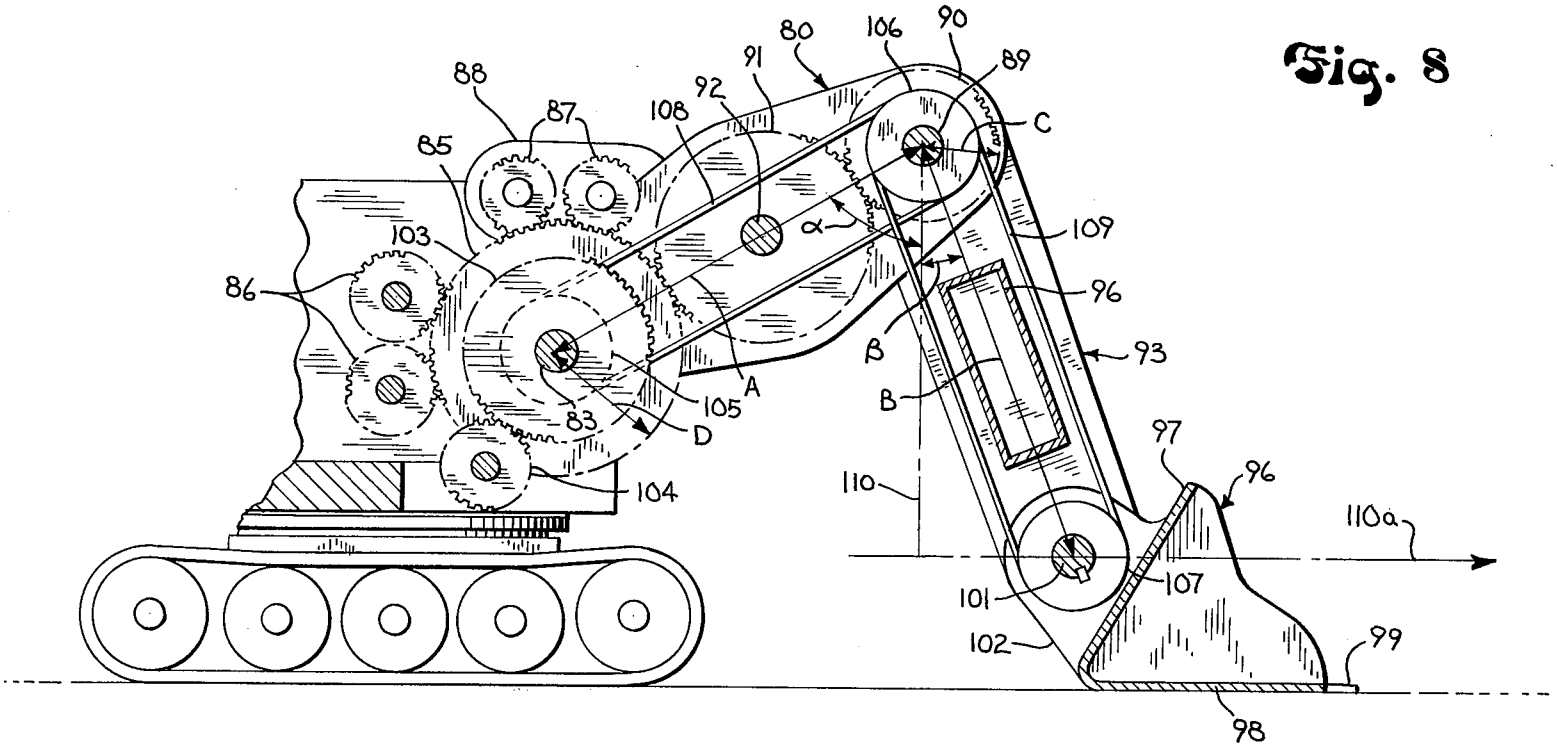
FIG. 8 is a side view in elevation of the front portion of an excavator incorporating another embodiment of the invention, which view is taken in the plane 8—8 indicated in FIG. 9.
Figure 9:
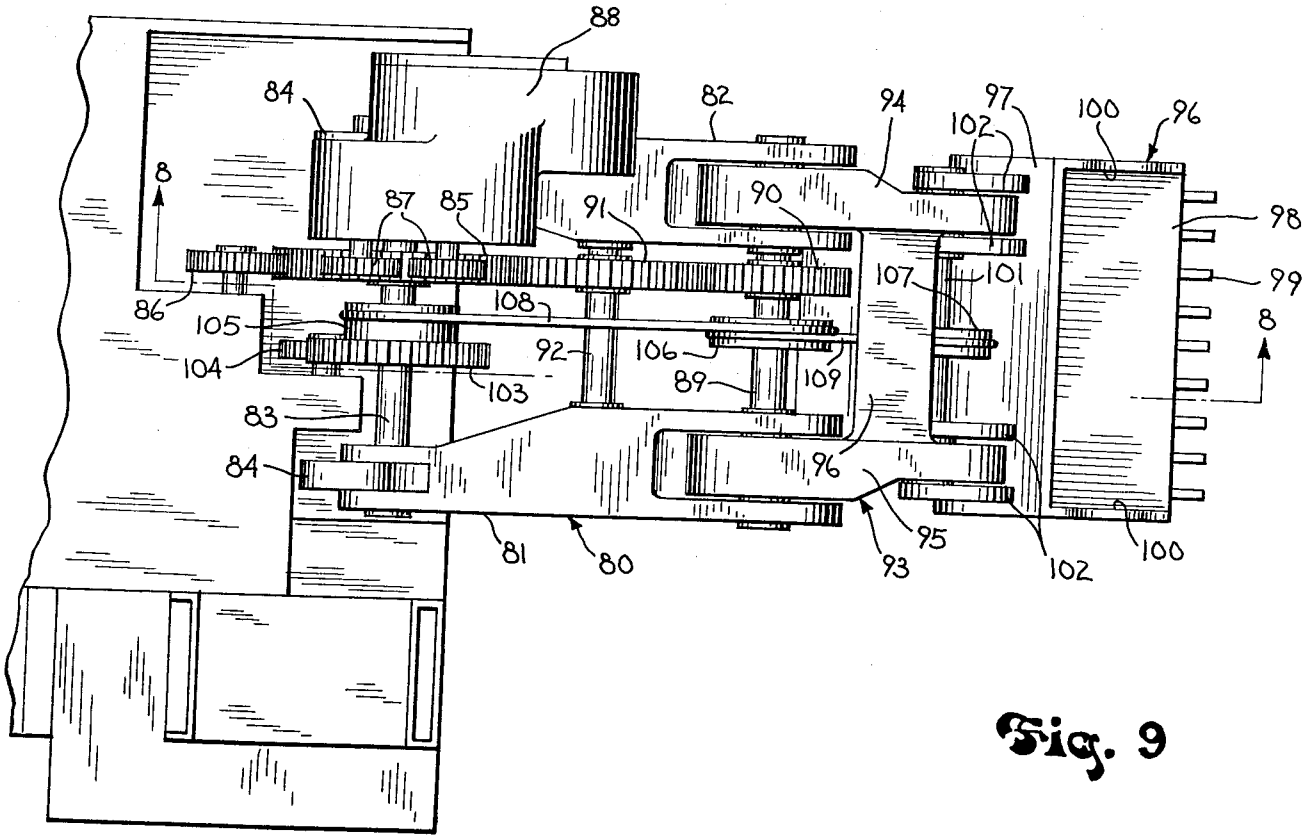
FIG. 9 is a top view of the front portion of the embodiment of FIG. 8.

FIGS. 8 and 9 show an embodiment of the front end mechanism, utilizing an all gear drive for the crowd and hoist motions. A boom 80 has a pair of laterally spaced box-type side members 81 and 82 that are pivotally mounted at their boom feet on a load bearing shaft 83 borne between a pair of stanchions 84. A large radius sun gear 85 rotatably mounted on the shaft 83 is in mesh with a pair of hoist-lower pinions 86 that are part of a hoist drive in the excavator house. A pair of crowd-retract pinions 87 are also in mesh with the sun gear 85, and they are part of a crowd drive located within a housing 88 mounted on the left side member 82 of the boom 80. Borne by and extending between the upper ends of the boom side members 81, 82 is an upper pivot shaft 89. A dipper stick turning gear 90 is keyed on the shaft 89, so that rotation of this gear 90 will cause like angular motion of the shaft 89. Interposed between and in mesh with both the sun gear 85 and the gear 90, is an intermediary idler gear 91 that is rotatably borne on an idler shaft 92 extending between the boom side members 81, 82. Thus, whenever any relative motion occurs between the sun gear 85 and the intermediary gear 91 the outer, dipper stick turning gear 90 is caused to turn about its axis to impart rotation to the pivot shaft 89.

A dipper stick 93 is constructed of a pair of laterally spaced side legs 94, 95 that are joined together by a box-like transverse girder member 96. The dipper legs 94, 95 are mounted at their upper, or inner ends on the pivot shaft 89, to make connection with the boom 80. The dipper legs 94, 95 are keyed to the shaft 89, so that as the shaft 89 is turned by the dipper stick turning gear 90 the dipper stick 93 will rotate in unison therewith.

A scoop-type dipper 96 includes a back wall 97, a bottom 98 with a plurality of outwardly extending spaced teeth 99 and a pair of laterally spaced end walls 100. The dipper 96 is pivotally connected to the lower, or outer ends of the dipper stick legs 94, 95 by a wristing shaft 101. Each of the lower ends of the dipper legs 94, 95 extends between a pair of spaced dipper mounting plates 102 projecting from the dipper back wall 97. The wristing shaft 101 extends between these mounting plates 102, and passes through the plates 102 and legs 94, 95. The mounting plates 102 are keyed to the wristing shaft 101, so that as the shaft 101 is turned the dipper 96 will rotate in unison therewith.

Adapted for independent rotation on the base shaft 83 is a wristing gear 103. In mesh with the wristing gear 103 is a wrist pinion gear 104 that is mounted on a shaft driven by a wristing power unit (not shown). As seen in FIG. 9, a first sheave 105 having a rope-receiving groove formed in its circumference is secured to the wristing gear 103 for rotation therewith. A second sheave 106 having a pair of spaced rope-receiving grooves formed in its circumference is mounted for independent rotation on the upper pivot shaft 89 between the upper ends of the boom side members 81, 82. A third sheave 107 with a single rope-receiving groove formed in its circumference is mounted on the wrist shaft 101 between the lower ends of the dipper legs 94, 95. The third sheave 107 is keyed to the shaft 101 to rotate in unison with the shaft 101 and the dipper 96. Connecting the first sheave 105 to the second sheave 106, and the second sheave 106 to the third sheave 107 is a pair of ropes 108 and 109 that are respectively seated in the circumferential sheave grooves and anchored so as to avoid slippage with respect to the sheaves.

In the excavator of FIGS. 8 and 9 the gearing comprising the sun gear 85, the intermediary gear 91 and the dipper stick turning gear 90 function to produce crowd and hoist motions like those of the first embodiment shown in FIGS. 1–4. This assemblage of gearing operates on similar principles as corresponding parts in the first embodiment. The dipper stick turning gear 90 has a radius indicated in FIG. 8 by the reference letter C corresponding to the radius C of the moment arm 16 of the dipper stick 13 in FIGS. 1–4, so that it presents a similar moment arm for turning the dipper stick 93 relative to the boom 80. The intermediary gear 91 is a coupling member corresponding to the coupling strut 18 in FIGS. 1–4, so that either a turning motion or a stationary condition at the periphery of the sun gear 85 is translated to the radius arm C. The point of mesh between the intermediary gear 91 and the dipper stick turning gear 90 corresponds to the connection provided by the coupling shaft 17 between the coupling strut 18 and the moment arm 16 in the excavator of FIGS. 1–4, and the point of mesh between the sun gear 85 and the intermediary gear 91 corresponds to the connection provided by the pin 22 at the end of the lever arm 23 in the embodiment of FIGS. 1–4. The sun gear 85, then, forms a hoist, or reaction member with a radius arm D that is similar to the gear 34. The boom 80 together with the three gears 85, 90 and 91 form a four element motion control assembly supporting the dipper stick 93 in like fashion as the four element quadrilateral in FIGS. 1–4 support the dipper stick 13.

To crowd the dipper 96, the hoist-retract pinions 86 are held stationary to prevent the sun gear 85 from rotating. The crowd-retract pinions 87 are then rotated by the crowd drive 88 causing them to walk forwardly about the circumference of the sun gear 85. This movement forces the boom 80 to move forwardly and downwardly, and at the same time forces the intermediary idler gear 91 to rotate clockwise, as viewed in FIG. 8. This clockwise movement imparts a counterclockwise rotation to the dipper stick turning gear 90. The counterclockwise movement of the gear 90 causes the outer end of the dipper stick 93 to move outwardly and upwardly with respect to the boom 80. The compound movement of a rotating, forwardly thrusting boom and a rotating, outwardly thrusting dipper stick provides a resultant crowd motion for the dipper 96, and the elements of the front end mechanism may be proportioned to obtain a straight line motion for the dipper 96, similarly as in the first embodiment. In this crowding motion the sun gear 85 functions as a reaction member against which the crowding forces work, similarly as for the hoist member 34 in the embodiment of FIGS. 1–4.

The dipper 96 may be raised or lowered by locking the crowd-retract pinions 87 from rotation, and then driving the hoist-lower pinions 86 to rotate the sun gear 85. The locking of the crowd-retract pinions 87 causes the boom 80 to rotate with the sun gear 85. When this occurs the intermediary idler gear 91 is held motionless with respect to the sun gear 85, and the dipper stick turning gear is likewise held from rotation. As a result, the dipper stick 93 remains fixed with respect to the boom 80, and as the boom is raised and lowered the dipper 96 is correspondingly hoisted or lowered as desired.

Wristing of the dipper 96 is accomplished by rotating the wristing gear 103 by the wrist pinion 104. As seen in FIG. 8, a clockwise rotation of the wrist pinion 104 causes the first sheave 105 to rotate counterclockwise. This rotation causes movement of the rope 108 to rotate the second sheave 106 counterclockwise. The rotation of the second sheave 106 simultaneously moves the rope 109 to cause the third sheave 107 to rotate counterclockwise. Since the third sheave 107 is keyed to the wrist shaft 101, the dipper 96 is also wristed counterclockwise. By rotating the wrist pinion 104 counterclockwise the dipper 96 is wristed in the opposite direction.

The wristing mechanism also retains the dipper 96 in the spatial orientation into which it is set by the operator. This is accomplished by the rope 108, the first sheave 105, and the second sheave 106 forming a first parallelogram that maintains the angular position of the upper sheave 106 with respect to the ground constant during a movement of the boom 80, and the rope 109, second sheave 106, and third sheave 107 forming a second parallelogram that maintains the angular position of the wrist shaft 101 with respect to the ground constant throughout a movement of the boom 80 and dipper stick 93. This arrangement will automatically retain the teeth 99 of the dipper 96 aligned parallel to the straight line of a digging stroke during a crowd, and also maintain the dipper 96 in position for retaining a load as the dipper is moved about from digging to dumping positions.

The proper proportioning of the front end mechanism to obtain a straight line crowding motion is the same as for the first embodiment of FIGS. 1–4. In FIG. 8 the several distances and angles that are taken into consideration for achieving this straight line motion are indicated as follows:

A is the length of the boom 80 from the axis of the shaft 83 to the axis of the upper pivot shaft 89;

B is the length of the dipper stick 93 from the axis of the upper pivot shaft 89 to the axis of the wrist shaft 101;

C is the radius of the dipper gear 90 that forms a moment arm for the dipper stick;

D is the radius of the sun gear 85;

$\alpha$ is the angle measured between (i) an upright line 110 running through the axis of the upper pivot shaft 89, that is perpendicular to the path of the straight line motion of the outer end of the dipper stick 93, which path is designated by the number 110*a* in FIG. 8, and (ii) the line A measuring the length of the boom 80; and $\beta$ is the angle measured between the same upright line 110 and the line B measuring the length of the dipper stick 93.

If the foregoing parameters are selected to satisfy the relationship as recited above for the first embodiment, namely:

$$A \cos \alpha + (B - A) = B \cos (\alpha [1 - \frac{D}{C}])$$

wherein the value $\alpha$ [1−D/C] is taken as the value of the angle $\beta$, then the outer end of the dipper stick 93 will automatically move in a straight line in a crowd motion.

Backhoe Embodiment

Figure 10:
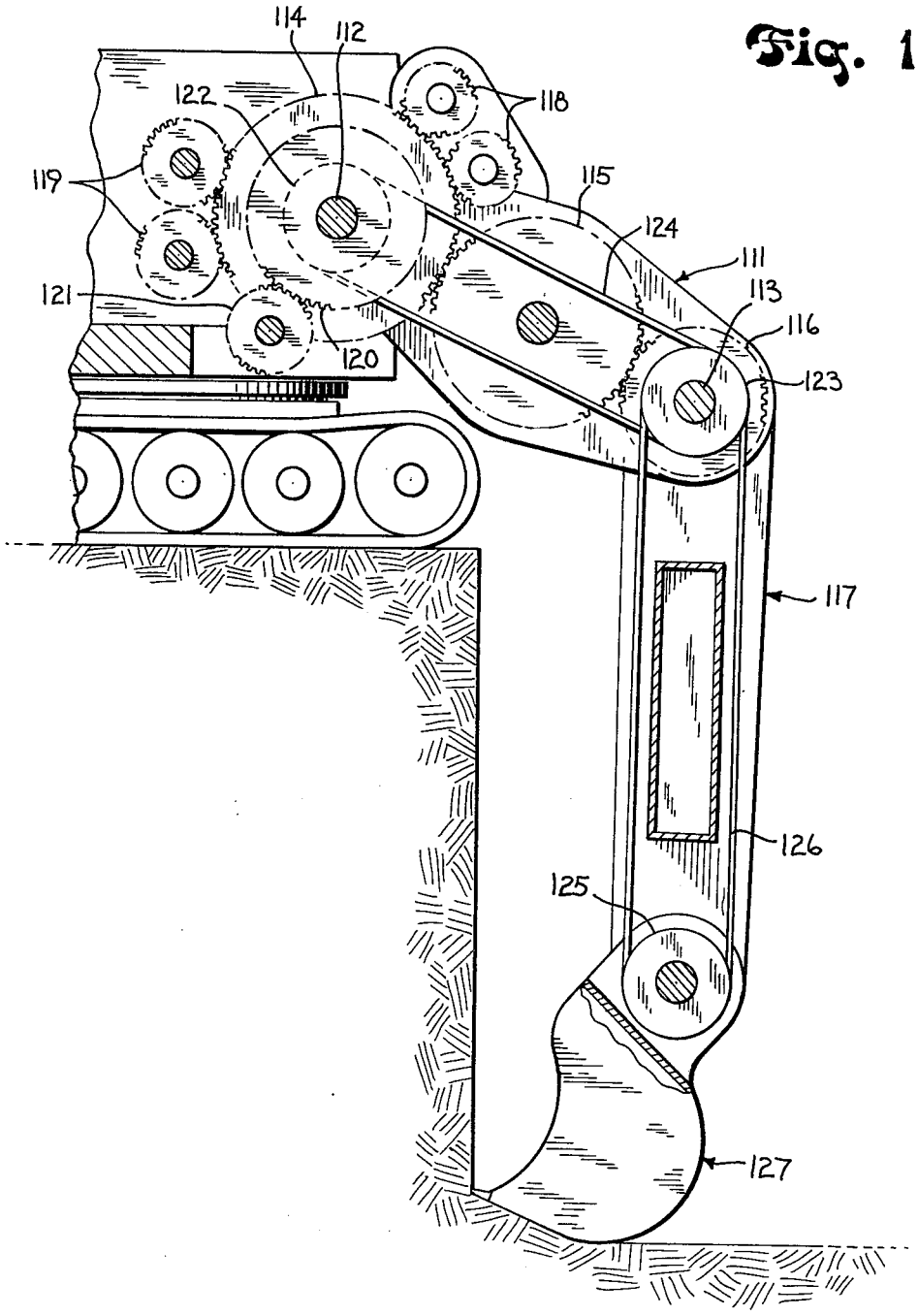
FIG. 10 is a side view in elevation, with parts cut away, of an embodiment of the invention in the form of a backhoe.

FIG. 10 shows an embodiment of the invention similar to the embodiment of FIGS. 8 and 9, but illustrating the use of the front end mechanism as a backhoe. This embodiment has a boom 111, shown in section, mounted on a base shaft 112 similar to the boom 80 of the embodiment of FIGS. 8 and 9. The boom 111 has an upper pivot shaft 113 and a set of three gears comprising a sun gear 114, an intermediary idler gear 115, and a dipper stick turning gear 116 like those in the embodiment of FIGS. 8 and 9. There is a dipper stick 117 attached to and pivotable with the shaft 113 at the forward end of the boom 111. A pair of crowd pinions 118 and hoist pinions 119 in mesh with the sun gear 114 are like their counterparts of the embodiment of FIGS. 8 and 9, and a wristing mechanism similar to that of the embodiment of FIGS. 8 and 9 has a wristing gear 120 in mesh with a wrist pinion gear 121 with a first sheave 122 and a second sheave 123 joined by a first rope 124, and the second sheave 123 joined to a third sheave 125 by a second rope 126. A dipper 127 is pivotally mounted at the outer end of the dipper stick 117 for backhoe digging.

As with the previous embodiments of the invention, the backhoe of FIG. 10 may be designed to have a crowd-retract motion in a horizontal, straight line at the outer end of the dipper stick 117, and this can be at a level beneath the ground line on which the excavator rests. The sheave and rope wristing mechanisms may set the dipper teeth in a position parallel to the straight line of digging in the same manner as the other embodiments. Since the sheaves 122, 123, 125 and ropes 124, 126 form a pair of parallelograms, the dipper 127 also remains in the proper attitude selected by the operator both for digging and other manipulations in the work cycle. The backhoe excavator illustrated in FIG. 10 may also dig in other than a straight line motion if desired, and simultaneous hoist and crowd movements can carry the dipper 127 through any desired path that is within the envelope of the limits of dipper travel.

Hydraulic Cylinder Embodiment

Figure 11:
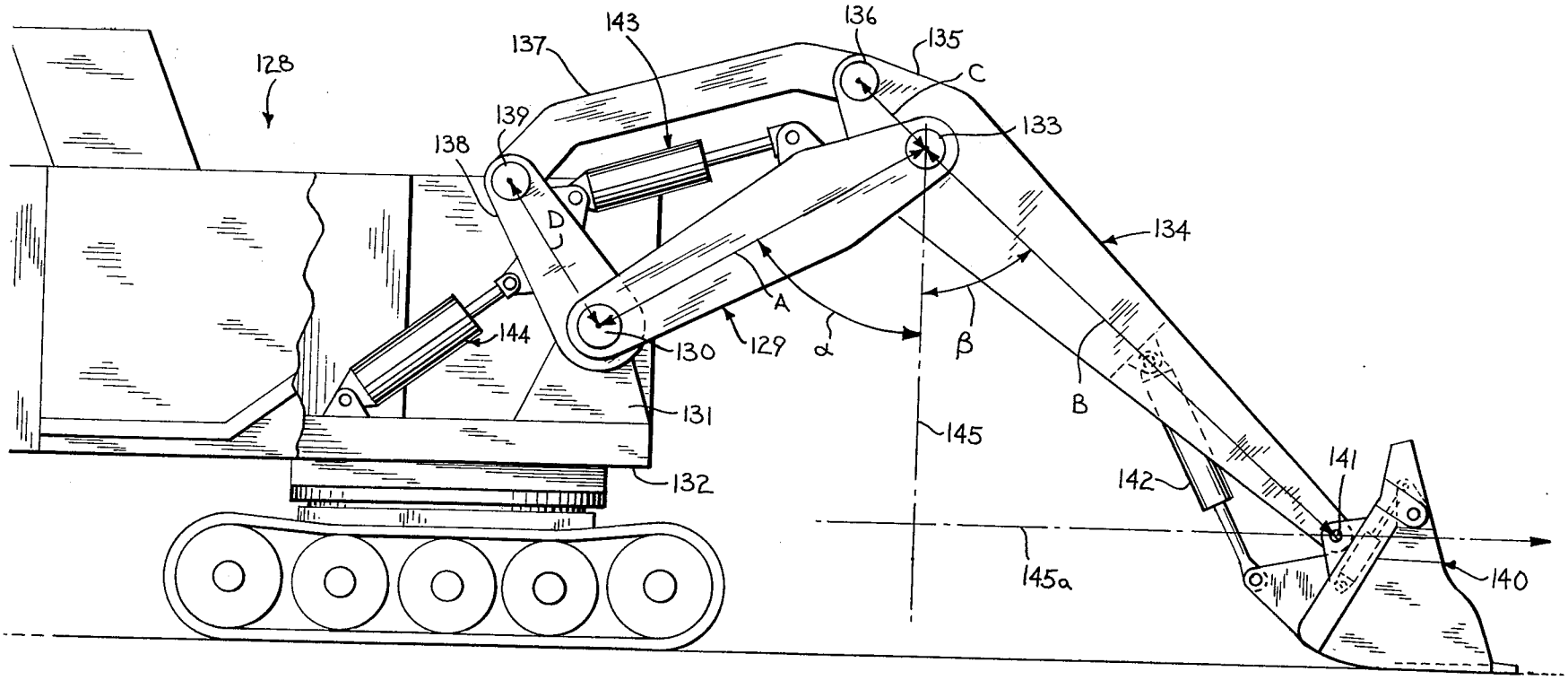
FIG. 11 is a side view in elevation, partially cut away, of an excavator incorporating an embodiment of the invention utilizing linkages for all the members of a front end mechanism of the invention.

FIG. 11 shows another embodiment for the front end mechanism of the invention using hydraulic cylinders to provide both crowd and hoist motions. This excavator 128 has a boom 129 mounted at its lower, foot end to a base shaft 130 that is supported by a pair of stanchions 131 mounted on a deck 132. The boom 129 has an upper pivot shaft 133 at its forward end on which a dipper stick 134 is pivotally mounted. The dipper stick 134 is like the dipper stick 13 of the embodiment in FIGS. 1–4, and similarly is made up of a pair of longitudinally extending side members joined together near their center by a transverse girder. The dipper stick 134 extends inwardly beyond the pivot shaft 133 to present dipper stick moment arms 135 similar to the arms 16 of FIGS. 1–4. Disposed between the moment arms 135 is a coupling shaft 136. A coupling strut 137 similar to the strut 18 of the first embodiment, is secured at one end to the coupling shaft 136 and extends downwardly over the boom 129 to pivotally connect at its lower end to the upper end of a hoist link or member 138 in the form of a lever arm. A pin 139 makes this latter connection. The hoist member 138 is pivotally mounted at its lower end on the base shaft 130, and it constitutes a reaction member similar to the hoist members of the other embodiments. A dipper 140 is pivotally connected to the outer end of the dipper stick 134 by wrist pins 141. The dipper 140 is wristed, similarly as in the first embodiment, by operation of wristing cylinders 142.

To provide motion for the front end mechanism of FIG. 11, there is a double acting hydraulic crowd-retract cylinder 143 mounted at its blind end to the boom 129 and at its rod end to the hoist member 138. Operation of the cylinder 143 changes the angular relation between the boom 129 and the hoist member 138. A double acting hydraulic hoist-lower cylinder 144 connects between the machinery deck 132 and the hoist member 138, with the blind end on the deck.

A crowd motion for the dipper 140 is accomplished by holding the hoist cylinder 144 from operation, so as to maintain the hoist member 138 in fixed position, and extending the cylinder 143. The boom 129 then moves forward and downward. At the same time the coupling strut 137, which has its lower end held fixed by the hoist member 138, in conjunction with the moment arms 135 of the dipper stick 134 causes the upper end of the dipper stick 134 to lag the forward and downward motion of the boom outer end. This causes the dipper stick 134 to thrust outward at its lower end, and also to rise relative to the boom 129. The combined movement of boom 129 and dipper stick 134 provide a crowd motion in which the dipper 140 is driven outward. This outward crowd can be a straight line motion, as in other embodiments of the invention, by proportioning the same elements in the same manner. These elements are the boom length A, dipper stick length B, moment arm length C, lever arm length D and the angles $\alpha$ and $\beta$, all of which are indicated in FIG. 11. Similar reference lines 145 and 145*a* are also shown in FIG. 11, and the straight line motion will then occur along the line 145*a*.

To retract the dipper 140, the crowd cylinder 143 is shortened. To obtain a hoist motion, the cylinder 143 is held at its length, so as to tie the hoist member 138 and the boom 129 together, and the hoist cylinder 144 is then retracted. This pivots the hoist member 138 and the boom 129 together as a unit. The dipper stick 134 also rises because of the fixed relationship of the coupling strut 137 and moment arm 135 with respect to the hoist member 138 and the boom 129. To lower the dipper 140 the cylinder 144 is lengthened to reverse the pivot of the hoist member 138 and boom 129.

Alternative Hydraulic Cylinder Embodiment

Figure 12:
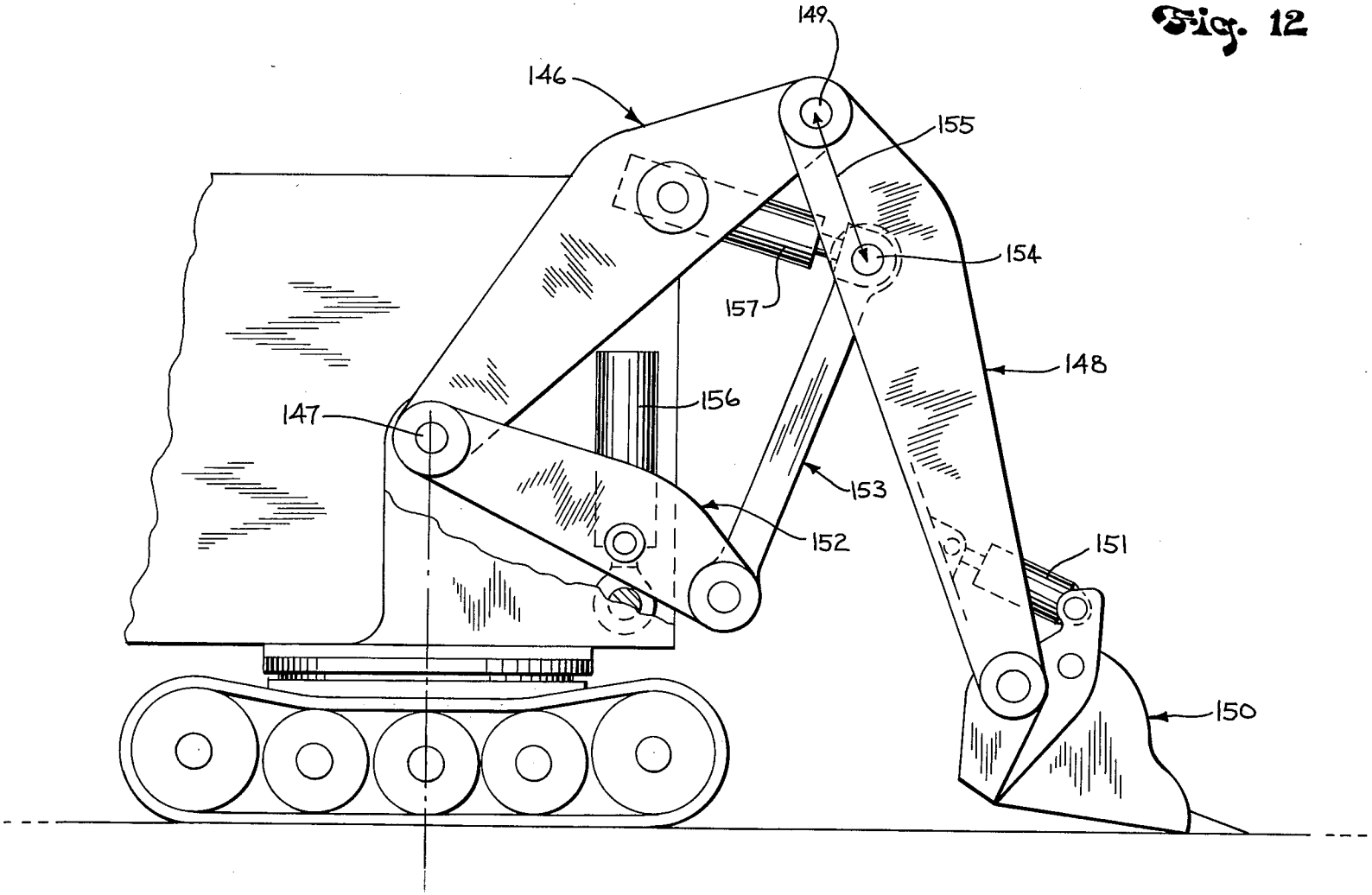
FIG. 12 is a side view in elevation of another embodiment utilizing an all linkage construction for the front end mechanism of the invention.

In FIG. 12 there is shown a second front end mechanism of the invention utilizing hydraulic cylinder drive units with an all linkage construction. It differs from the embodiment of FIG. 11 primarily by placing the hoist member and coupling member below the boom.

A boom 146 is pivoted to stanchions rising from the excavator machinery deck through a shaft 147 at the boom foot. A dipper stick 148 is pivoted at its inner end to the forward end of the boom 146 by a shaft 149. A dipper 150 is mounted on the outer end of the dipper stick 148 which can be wristed by operation of a wristing cylinder 151.

Extending obliquely downward and forward from the boom foot shaft 147 is a hoist link or member 152, and pivoted to its forward end is the lower end of a coupling strut 153. The upper end of the strut 153 is pivoted near the inner end of the dipper stick 148 by a pin 154. The pin 154 is spaced from the shaft 149 at a distance 155 which forms a dipper stick moment arm 155 that extends radially from the connection between the dipper stick 148 and the boom 146.

A hoist-lower cylinder 156 is pivotally mounted at its lower end to the excavator machinery deck, and it is also pivotally connected to the hoist member 152. The cylinder 156 functions to either hold the hoist member 152 stationary, or to turn the hoist member 152 in order to produce a hoist-lower motion. A crowd-retract cylinder 157 is connected at its blind end to the boom 146 and at its rod end to the pin 154. Operation of the cylinder 157 will produce a crowd-retract motion like that of the other embodiments, and by proper proportioning of the elements a straight line digging stroke can be accomplished. The front end mechanism of FIG. 12 presents a low profile with a relatively low center of gravity.

Conclusion

The several forms of the invention illustrated in the drawings provide two points of support for a dipper stick that can be remote from a connection with a power unit. One point of support is a usual pivoted connection with a boom, and the other point is a connection with a coupling member. The distance between the points of connection form a moment arm for the dipper stick, and the point of connection with the coupling member can be either a pinned connection with a strut like coupling member, or a point of mesh between gears when the coupling member comprises a gear.

The supporting structure for the dipper stick, in the illustrated embodiments, is a four element structure of which the dipper stick moment arm is a part. The other elements are a boom pivoted to the machinery platform, a hoist member pivoted alongside the boom and the coupling member. The four elements can all be links that form a quadrilateral, or some of the elements can comprise gears, but in the forms shown the four elements comprise a pivoted motion control assembly for the dipper stick.

The power drives attach to the four element motion control assembly. The hoist-lower power drive preferably connects to the hoist member, such member also functioning as a reaction member for the forces developed in crowding and retracting. The crowd-retract power drive connects between elements of the motion control assembly to produce relative movement of these elements. The location and connections of this latter power drive can be selected for optimum efficiency. Although the boom is conventionally the larger unit of the motion control assembly, and renders physical stability to the structure, it could become a lesser sized element depending upon placement and size of the power drives. Also, the hoist member may not necessarily be the element to which hoist-lower force is applied, or be a reaction member during crowding or retracting.

As has been described the hoist-lower and crowd-retract power drive units are inboard, or to the rear, of the dipper stick connection with the boom. This removes the crowd drive, as well as the hoist drive, from the vicinity of digging, so that they both are in a relatively protected position. The mass of these units is also closer to the machinery deck to enhance the load capability of the excavator. The mechanism also utilizes a boom and dipper stick that are connected to one another in a toggle arrangement in which the knee, or point of connection, of the toggle straightens in applying a crowd motion. A force for crowding is applied through the knee, and by reason of the toggle action a high crowding force is maintained at outwardly extended dipper positions. A further advantage that is attainable is the straight line crowd-retract motion. Digging can be accomplished solely by crowding, without any need of a simultaneous coordination of the hoist-lower controls by the operator. A highly effective excavator results from this arrangement, and the mechanism of the invention may find application in diverse machines such as log and cane loaders, as well as shovels for excavating.

I claim:

1. In a front end mechanism for excavators and the like, the combination comprising:

a. a boom member pivotally mounted at its foot;

b. a dipper stick pivoted to said boom that extends from the boom;

c. a moment arm forming a part of said dipper stick that presents a turning radius extending from the pivoted connection of the dipper stick and boom;

d. a rotatable hoist member having a pivoted mounting and extending radially from its pivot to present a radius arm;

e. a coupling member cooperatively engaged between said moment arm and said hoist member radius arm at a position outwardly of its pivoted mounting;

f. said boom member, moment arm, hoist member, and coupling member forming a pivoted four element motion control assembly supporting said dipper stick;

g. a crowd drive positioned between elements of said motion control assembly and operable to develop relative movement between said boom and the other assembly elements to crowd said dipper stick; and h. a hoist drive in driving relation to said hoist member to rotate said hoist member about its pivoted mounting and pivot said boom about said boom foot.

2. A front end mechanism as in claim 1, in which:

a. said hoist member includes gearing substantially coaxial with the boom foot;

b. said crowd drive includes pinion gearing mounted on said boom in mesh with said hoist member gearing; and c. said hoist drive includes pinion gearing in driving relation to said hoist member gearing.

3. A front end mechanism as in claim 1, in which:

a. said boom member, moment arm, hoist member and coupling member are elongate elements whereby said four element motion control assembly is a quadrilateral pivoted at said boom foot; and b. said crowd drive and said hoist drive comprise hydraulic cylinders.

4. A front end mechanism as in claim 3, in which:

a. said hoist member extends upward from the boom foot;

b. said coupling member is positioned above said boom member; and c. said dipper stick moment arm is an extension of said dipper stick extending away from the dipper stick outer end.

5. A front end mechanism as in claim 3, in which:

a. said hoist member extends downward from the boom foot;

b. said coupling member is positioned below said boom member; and c. said dipper stick moment arm is a part of said dipper stick extending between the connection of the stick with said boom and the outer end of said stick.

6. In a front end mechanism for excavators and the like, the combination comprising:

a. a boom pivotally mounted at its foot;

b. a stick pivoted to said boom that extends outwardly from the boom;

c. a moment arm forming a part of said stick that extends from the pivoted connection of the stick and boom;

d. a rotatable reaction member having a pivoted mounting and extending radially from its pivot to present a radius arm;

e. a coupling between said moment arm and said reaction member radius arm at a position outwardly of its pivoted mounting; and f. a crowd unit for moving said boom relative to said moment arm, reaction member and coupling and causing said dipper stick to pivot relative to said boom upon motion being imparted to said boom.

7. In a front end mechanism for excavators and the like, the combination comprising:

a. a boom pivotally mounted at its foot;

b. a dipper stick pivoted to said boom at a point remote from said boom foot;

c. a moment arm forming a part of said dipper stick which extends from the connection of the dipper stick with the boom;

d. a rotatable reaction member alongside said boom foot having a pivoted mounting and extending radially from its pivot;

e. a coupling interposed between and connecting with said dipper stick moment arm and said reaction member at a position disposed radially from the reaction member mounting;

f. said boom, dipper stick moment arm, reaction member and coupling forming a four element assembly;

g. a crowd drive operatively connected to said assembly to move the elements of the assembly relative to one another; and h. a hoist drive operatively connected to said reaction member to rotate said reaction member about its pivoted mounting and pivot said boom about said boom foot.

8. A front end mechanism as in claim 7, in which:

a. said reaction member is pivoted in coaxial relation to said boom to turn therewith;

b. said crowd drive locks said reaction member and said boom together as a unit when not imparting a crowd or retract motion to the mechanism; and c. said hoist drive pivots both said boom and said reaction member.

9. A front end mechanism as in claim 7 in which:

a. said dipper stick moment arm is a lever arm projecting from the pivoted connection with said boom;

b. said reaction member is a second lever arm extending from the pivoted mounting of said boom;

c. said coupling member is a strut extending between said dipper stick moment arm and said reaction member;

d. said crowd drive is joined between said boom and said reaction member to impart relative movement therebetween; and e. said hoist drive pivots said boom and reaction member together.

10. A front end mechanism as in claim 9, wherein said crowd and hoist drives are hydraulic cylinders.

11. In a front end mechanism for excavators and the like, the combination comprising:

a. a boom pivoted at its boom foot and extending forwardly therefrom;

b. a rotatable hoist member having a pivoted mounting coaxial with said boom foot and extending radially from its pivot to present a first radius arm;

c. a dipper stick pivoted to said boom at a position forward from said boom foot having a moment arm extending from its pivot with said boom that presents a second radius arm;

d. a dipper pivotally connected to said dipper stick at its outer end;

e. coupling means interposed between said hoist member and said dipper stick moment arm that engages with the outer terminus of each of said first and second radius arms;

f. a hoist power means engaged with said hoist member to rotate said member about its pivoted mounting; and g. a crowd power means operatively positioned between said boom and said hoist member to develop relative movement between said boom and said hoist member.

12. A front end mechanism as in claim 11, wherein:

a. said hoist member comprises a first gear rotatably mounted alongside said boom foot;

b. said moment arm comprises a dipper stick gear at the upper end of said boom; and c. said coupling means comprises an idler gear disposed between and in mesh with both said first gear and said dipper stick gear.

13. A front end mechanism as in claim 12, wherein:

a. said hoist power means comprises at least one hoist pinion gear in mesh with said first gear and driven by a first prime mover; and b. said crowd power means comprises at least one crowd pinion gear in mesh with said first gear and driven by a second prime mover.

14. A front end mechanism as in claim 11, wherein:

a. said hoist member comprises a lever arm rotatably mounted at said boom foot;

b. said moment arm comprises a part of said dipper stick that extends from its pivot connection with said boom; and c. said coupling means comprises a strut pivotally connected at one end to said moment arm and at its other end to said lever arm.

15. A front end mechanism as in claim 14, wherein:

a. said hoist member includes a gear mounted coaxial with said lever arm;

b. said hoist power means comprises at least one pinion gear in mesh with said gear driven by a first power source; and c. said crowd power means comprises at least one crowd pinion gear in mesh with said gear and driven by a second power source.

16. A front end mechanism as in claim 14, wherein:

a. said hoist power means comprises a first hydraulic cylinder for rotating said lever arm; and b. said crowd power means comprises a second hydraulic cylinder for rotating said boom relative to said lever arm.

17. In a front end mechanism for an excavator and the like, the combination comprising:

a. a boom projecting from a pivoted mounting at its foot;

b. a gear rotatably mounted alongside the pivoted foot of said boom;

c. a first radius arm rotatable with and coaxially disposed with said gear that extends radially therefrom to present a first coupling connection at its end;

d. a dipper stick pivoted to said boom with a dipper at its outer end, and providing a second radius arm extending from the pivot with said boom that presents a second coupling connection at its end;

e. a coupling strut extending between and joined to said first and second coupling connections;

f. a hoist drive in engagement with said gear for rotating said gear;

g. a crowd drive on said boom in engagement with said gear for rotating said boom with respect to said first radius arm; and h. wristing means for automatically maintaining said dipper aligned in its spatial position during a crowding motion of said boom and dipper stick.

18. A front end mechanism as in claim 17, wherein said wristing means comprises:

a. a wristing gear having a pivoted mounting coaxial with said boom foot and adapted for independent rotation with respect to said boom foot;

b. a wrist power means engaged with said wristing gear to rotate said wristing gear about its pivotal mounting;

c. a first rack pinion coupled to said wristing gear for rotation therewith;

d. a second rack pinion mounted coaxially with said second radius arm for rotation therewith;

e. a pair of reciprocating racks longitudinally disposed and in mesh with said first and second rack pinions;

f. a first pair of sheaves mounted coaxially with said second rack pinion for rotation therewith;

g. a second pair of sheaves having a pivoted mounting at the outer end of said dipper stick; and h. a pair of ropes forming closed loops around respective sets of first and second sheaves.

19. In a front end mechanism for an excavating machine and the like, the combination comprising:

a. a boom having a pair of boom members pivotally mounted at their boom feet and extending outwardly therefrom;

b. a sun gear pivotally mounted coaxially with said boom members and extending radially therefrom defining a first radius arm;

c. a dipper stick having a pair of dipper stick members pivotally connected to the outer ends of said boom members, with a dipper pivotally connected to its lower end;

d. said pivotal connection having coaxially engaged therewith a dipper stick gear disposed between said boom members and said dipper stick members, and extending radially therefrom to define a second radius arm;

e. an idler gear pivotally connected between said boom members, and disposed between and engaged with said sun gear and said dipper stick gear;

f. a pair of hoist pinion gears engaged with said sun gear to rotate said sun gear about its pivot mounting; and g. a pair of crowd pinion gears mounted on said boom and engaged with said sun gear to rotate said boom relative to said sun gear.

20. A front end mechanism as in claim 19, further including an automatic wristing mechanism, comprising:

a wristing gear having a pivoted mounting coaxial with said boom feet and adapted for independent rotation with respect to said boom feet;

b. a wrist power means engaged with said wristing gear to rotate said wristing gear about its pivotal mounting;

c. a first sheave coupled with said wristing gear for rotation therewith;

d. a second sheave mounted coaxially with said dipper stick gear;

e. a first rope forming a closed loop around said first and second sheaves;

f. a third sheave pivotally mounted coaxially with said dipper; and g. a second rope forming a closed loop around said second and third sheaves.

21. In a front end mechanism for an excavating machine and the like, the combination comprising:

a. a boom member pivotally mounted at its boom foot and extending forwardly therefrom;

b. a lever arm member pivotally mounted coaxially with said boom foot and extending radially therefrom to present a first radius arm;

c. a dipper stick pivotally connected to the outer end of said boom, said dipper stick having a moment arm member extending from said pivotal connection to present a second radius arm;

d. a coupling strut member disposed between and pivotally connected to its upper end to said moment arm member and at its lower end to said lever arm member;

e. a first hydraulic cylinder engaged with said lever arm member for rotating said lever arm about its pivotal mounting; and f. a second hydraulic cylinder attached between a pair of said members for rotating said boom with respect to said lever arm.

22. In a front end mechanism for excavators and the like, the combination comprising:

a. a boom member pivotally mounted at its foot;

b. a dipper stick pivoted to said boom that extends from the boom;

c. a moment arm forming a part of said dipper stick that presents a turning radius extending from the pivoted connection of the dipper stick and boom, said moment arm includes gearing on the dipper stick that is substantially coaxial with the pivot between said boom and said dipper stick;

d. a hoist member pivotally mounted at the boom foot that includes gearing substantially coaxial with the boom foot;

e. a coupling member cooperatively engaged between said moment arm and said hoist member that includes gearing disposed between said hoist member gearing and said dipper stick gearing;

f. said boom member, moment arm, hoist member, and coupling member forming a pivoted four element motion control assembly supporting said dipper stick;

g. a crowd drive positioned between elements of said motion control assembly for causing relative movement of assembly elements to crowd said dipper stick; and h. a hoist drive in driving relationship to said hoist member to pivot said motion control assembly about said boom foot.

23. A front end mechanism as in claim 22, in which:

a. said crowd drive is mounted on said boom and includes gearing in mesh with said hoist member gearing; and b. said hoist drive includes gearing in meshed driving relation to said hoist member gearing.

24. In a front end mechanism for excavators and the like, the combination comprising:

a. a boom member pivotally mounted at its foot;

b. a dipper stick pivoted to said boom that extends from the boom;

c. a moment arm forming a part of said dipper stick that presents a turning radius extending from the pivoted connection of the dipper stick and boom;

d. a hoist member pivotally mounted at the boom foot;

e. a coupling member cooperatively engaged between said moment arm and said hoist member;

f. said boom member, moment arm, hoist member, and coupling member forming a pivoted four element motion control assembly supporting said dipper stick;

g. a crowd drive positioned between elements of said motion control assembly for causing relative movement of assembly elements to crowd said dipper stick;

h. a hoist drive in driving relation to said hoist member to pivot said motion control assembly about said boom foot;

i. said boom member has a length A measured between its pivoted mounting and its connection with said dipper stick;

j. said dipper stick has a length B measured outward from its connection with said boom;

k. said dipper stick moment arm has a length C;

l. said hoist member has a radius arm of length D between its pivotal mounting and its engagement with said coupling member;

m. $\alpha$ is an angle between a perpendicular to a line of motion of the dipper stick outer end and the boom length A;

n. $\beta$ is an angle between said perpendicular and the dipper stick length B; and o. the foregoing dimensions satisfy the relationship:

$$A \cos \alpha + (B - A) = B \cos (\alpha[1 - (D/C])$$

in which the value $\alpha[1-(D/C]$ is the angle $\beta$.

25. In a front end mechanism for excavators and the like, the combination comprising:

a. a boom pivotally mounted at its foot;

b. a stick pivoted to said boom that extends outwardly from the boom;

c. a moment arm forming a part of said stick that extends from the pivoted connection of the stick and boom, said dipper stick moment arm is a lever arm projecting from the pivoted connection with said boom;

d. a reaction member at the boom foot, said reaction member includes a gear extending about the pivoted mounting of said boom;

e. a coupling between said moment arm and said reaction member, said coupling is a strut extending between said lever arm of said dipper stick and said reaction member;

f. a crowd unit for moving said boom and causing said dipper stick to pivot relative to said boom upon motion being imparted to said boom, said crowd drive has a driving pinion carried by said boom that engages said reaction member gear; and g. a hoist unit operably connected to said reaction member, said hoist unit has a driving pinion engaging said reaction member gear.

26. In a front end mechanism for excavators and the like, the combination comprising:

a. a boom pivotally mounted at its foot;

b. a dipper stick pivoted to said boom at a point remote from said boom foot;

c. a moment arm forming a part of said dipper stick which extends from the connection of the dipper stick with the boom, said dipper stick moment arm is a lever arm projecting from the pivoted connection with said boom;

d. a rotatable reaction member alongside said boom foot, said reaction member includes a gear extending about the pivoted mounting of said boom;

e. a coupling interposed between and connecting with said dipper stick moment arm and said reaction member, said coupling is a strut extending between said lever arm of said dipper stick and said reaction member;

f. said boom, dipper stick moment arm, reaction member and coupling forming a four element assembly;

g. a crowd drive operatively connected to said assembly to move the elements of the assembly relative to one another, said crowd drive has a driving pinion carried by said boom that engages said reaction member gear; and h. a hoist drive operatively connected to said reaction member, said hoist drive has a driving pinion engaging said reaction member gear.

27. In a front end mechanism for excavators and the like, the combination comprising:

a. a boom pivotally mounted at its foot;

a stick pivoted to said boom that extends outwardly from the boom;

c. a moment arm forming a part of said stick that extends from the pivoted connection of the stick and boom, said dipper stick moment arm is a gear extending around the pivoted connection with said boom;

d. a reaction member at the boom foot, said reaction member is a gear extending around the pivoted mounting of said boom;

e. a coupling between said moment arm and said reaction member, said coupling is a gear interposed between said other gears;

f. a crowd unit for moving said boom and causing said dipper stick to pivot relative to said boom upon motion being imparted to said boom, said crowd drive has a driving pinion carried by said boom that engages said reaction member; and g. a hoist unit operably connected to said reaction member, said hoist unit has a driving pinion engaging said reaction member.

28. In a front end mechanism for excavators and the like, the combination comprising:

a. a boom pivotally mounted at its foot;

b. a dipper stick pivoted to said boom at a point remote from said boom foot;

c. a moment arm forming a part of said dipper stick which extends from the connection of the dipper stick with the boom, said dipper stick moment arm is a gear extending around the pivoted connection with said boom;

d. a rotatable reaction member alongside said boom foot, said reaction member is a gear extending around the pivoted mounting of said boom;

e. a coupling interposed between and connecting with said dipper stick moment arm and said reaction member, said coupling is a gear interposed between said other gears;

f. said boom, dipper stick moment arm, reaction member and coupling forming a four element assembly;

g. a crowd drive operatively connected to said assembly to move the elements of the assembly relative to one another, said crowd drive has a driving pinion carried by said boom that engages said reaction member; and h. a hoist drive operatively connected to said reaction member, said hoist drive has a driving pinion engaging said reaction member.

29. In an excavating mechanism or the like, the combination comprising:

a boom pivoted at its boom foot and extending outwardly therefrom;

b. a rotatable hoist member that is pivotally mounted and extends from its pivot to present a first radius arm;

c. a stick pivoted to said boom at a position outwardly from said boom foot;

d. a moment arm forming a part of said stick that presents a second radius arm extending from the pivot of said stick with said boom;

e. a coupling interposed between said hoist member and said moment arm that engages with said first and second radius arms at positions spaced from the pivots of the arms;

f. said boom hoist member, coupling, and moment arm presenting a motion control assembly for supporting and manipulating said stick;

g. crowd power means associated with said motion control assembly that upon operation moves the members of the mechanism relative to one another to move said stick in a crowd motion; and h. hoist power means engaged with said hoist member to rotate said first radius arm for turning said motion control assembly in a hoist motion.

* * * * *